US008833325B2

(12) United States Patent
Hashimoto et al.

(10) Patent No.: US 8,833,325 B2
(45) Date of Patent: Sep. 16, 2014

(54) IN-VEHICLE ENGINE START CONTROL APPARATUS

(75) Inventors: Koji Hashimoto, Tokyo (JP); Shiro Yonezawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 248 days.

(21) Appl. No.: 13/325,939

(22) Filed: Dec. 14, 2011

(65) Prior Publication Data

US 2012/0318227 A1 Dec. 20, 2012

(30) Foreign Application Priority Data

Jun. 15, 2011 (JP) ..... 2011-133186

(51) Int. Cl.

| | |
|---|---|
| ***F02N 11/08*** | (2006.01) |
| ***F02N 15/06*** | (2006.01) |
| ***F02N 99/00*** | (2010.01) |
| *F02N 11/14* | (2006.01) |
| *F02D 41/00* | (2006.01) |

(52) U.S. Cl.

CPC ..... *F02N 11/0855* (2013.01); *F02N 11/0814* (2013.01); *F02N 11/0851* (2013.01); *F02D 41/0097* (2013.01); *F02N 15/067* (2013.01); *F02N 99/006* (2013.01); *F02N 2200/022* (2013.01); *F02N 2200/048* (2013.01)

USPC ..... 123/179.4; 701/112

(58) Field of Classification Search

CPC ..... F02N 11/0814; F02N 11/0851; F02N 11/0855; F02N 2200/048

USPC ..... 123/179.3, 179.4, 179.16, 179.22, 123/179.24, 339.14; 701/112, 113, 102

See application file for complete search history.

(56) References Cited

U.S. PATENT DOCUMENTS

| | | | | |
|---|---|---|---|---|
| 6,634,332 | B2 | 10/2003 | Saito et al. | |
| 2002/0017260 | A1 | 2/2002 | Saito et al. | |
| 2004/0149247 | A1 * | 8/2004 | Kataoka et al. | 123/179.4 |
| 2010/0242905 | A1 * | 9/2010 | Machida et al. | 123/339.14 |
| 2011/0174255 | A1 | 7/2011 | Neuburger et al. | |

FOREIGN PATENT DOCUMENTS

| | | | |
|---|---|---|---|
| CN | 101846002 | A | 9/2010 |
| JP | 2002-70699 | A | 3/2002 |
| JP | 2002-122059 | A | 4/2002 |
| JP | 2002-122059 | A | 4/2002 |
| JP | 2002-221133 | A | 8/2002 |

(Continued)

OTHER PUBLICATIONS

Japanese Office action issued Feb. 5, 2013 in Japanese Patent Application No. 2011-133186.

(Continued)

*Primary Examiner* — Mahmoud Gimie
(74) *Attorney, Agent, or Firm* — Sughrue Mion, PLLC

(57) ABSTRACT

An in-vehicle engine start control apparatus stops a fuel injection instruction after rotationally driving a DC electric motor preliminarily by issuing a rotational driving instruction when an automatic stop condition is satisfied, and subsequently restarts the in-vehicle engine by issuing a push control instruction to a pinion gear immediately before a circumferential speed of a ring gear decelerating by inertia is synchronized with a circumferential speed of the pinion gear rotationally driven preliminarily to rotate and by issuing the rotational driving instruction and the fuel injection instruction again because a restart request is already issued or is issued with a delay when the push driving is completed.

14 Claims, 9 Drawing Sheets

(56) References Cited

FOREIGN PATENT DOCUMENTS

| | | | |
|---|---|---|---|
| JP | 2002-303232 | A | 10/2002 |
| JP | 2005-330813 | A | 12/2005 |
| JP | 2006-046096 | A | 2/2006 |
| JP | 2007-113397 | A | 5/2007 |
| JP | 2009-30543 | A | 2/2009 |
| JP | 2009-287459 | A | 12/2009 |
| JP | 2010-229882 | A | 10/2010 |
| JP | 2011-064093 | A | 3/2011 |
| WO | 2010/012530 | A1 | 2/2010 |
| WO | 2011/025411 | A1 | 3/2011 |

OTHER PUBLICATIONS

Chinese Office Action, dated Apr. 22, 2014, issued in Chinese Patent Application No. 201110440644.9.

* cited by examiner 10
11
12
13
14
40A
44A
44a
44b
43a
43b
43c
45a
45b
46A
46A1
42a
42b
48
41a
M
G
50A
51a
51b
51c
52a
52b
52c
R
T
35a
35b
34
36
37a
37b
37c
INH
Sc
Rc
Tc
ECU
Es
Vb
Dr
Ps
St
INJ
Ne
PMEM
CPU
31A
33A
32
LOAD
25
SENSOR
24
20
21
22
23
23a
23b
30A
54a
54b
55
56
57
58a
58b
59

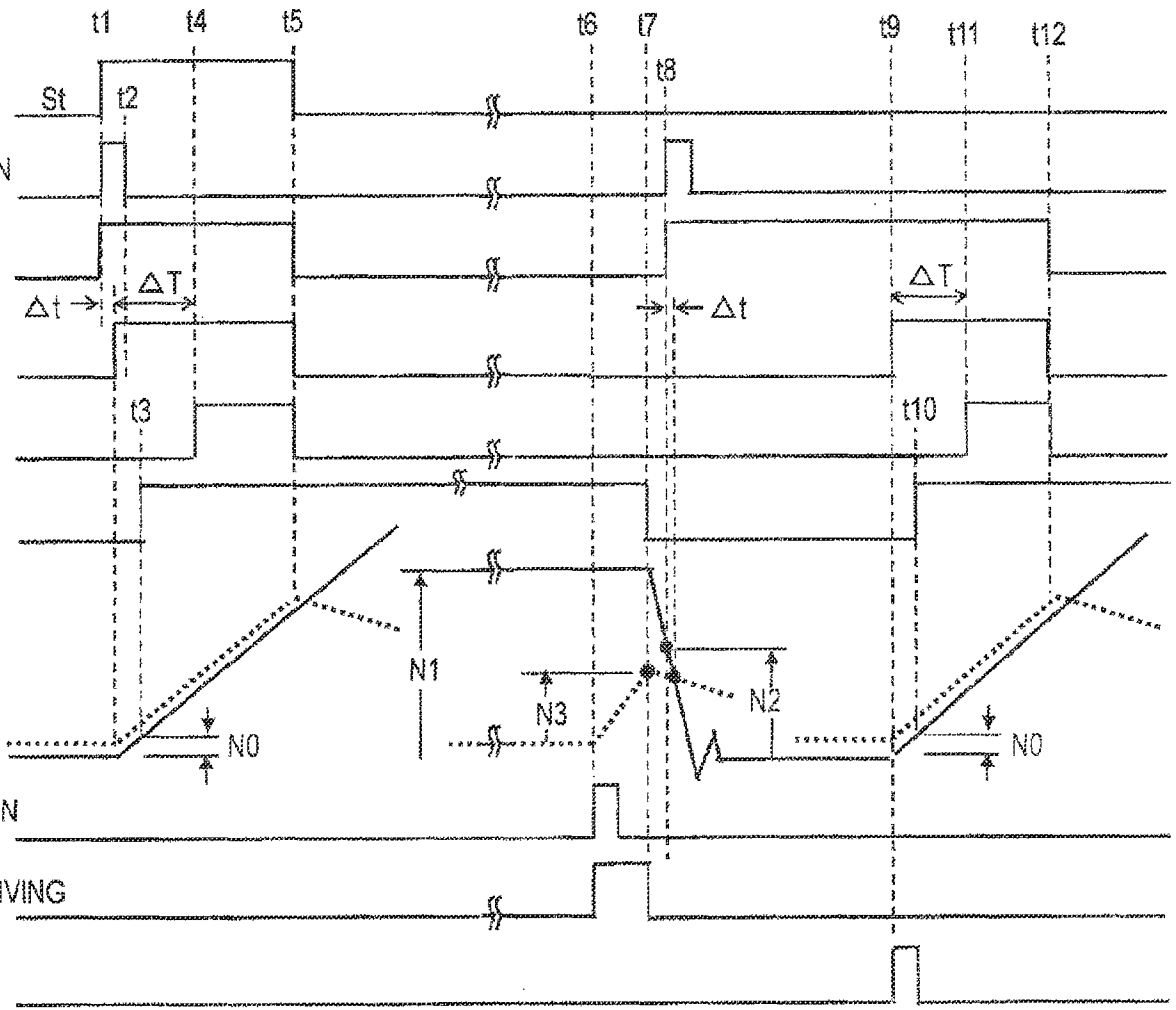
St
t1
t2
t3
t4
t5
t6
t7
t8
t9
t10
t11
t12
ΔT
Δt
N0
N1
N2
N3
FIG.2A START INSTRUCTION
FIG.2B SHIFT ATTRACTING OPERATION
FIG.2C SHIFT HOLDING OPERATION
FIG.2D CURRENT-LIMIT STARTING
FIG.2E FULL VOLTAGE STARTING
FIG.2F FUEL SUPPLY AND IGNITION
FIG.2G ENGINE ROTATION SPEED
CONVERTED PINION
ROTATION SPEED
FIG.2H AUTOMATIC STOP INSTRUCTION
FIG.2J PRELIMINARY ROTATIONAL DRIVING
FIG.2K RESTART INSTRUCTION

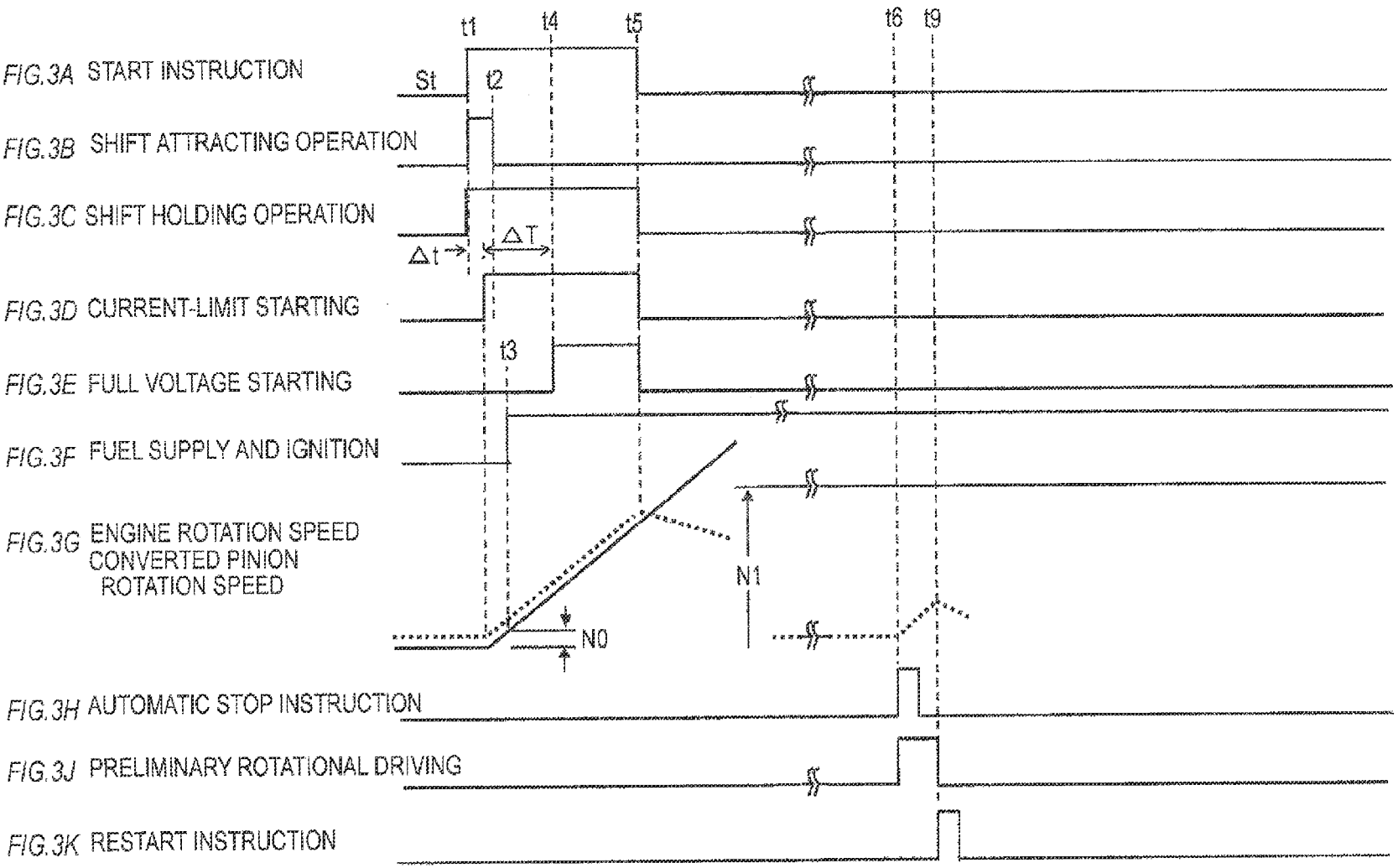
FIG.3A START INSTRUCTION
FIG.3B SHIFT ATTRACTING OPERATION
FIG.3C SHIFT HOLDING OPERATION
FIG.3D CURRENT-LIMIT STARTING
FIG.3E FULL VOLTAGE STARTING
FIG.3F FUEL SUPPLY AND IGNITION
FIG.3G ENGINE ROTATION SPEED
CONVERTED PINION
ROTATION SPEED
FIG.3H AUTOMATIC STOP INSTRUCTION
FIG.3J PRELIMINARY ROTATIONAL DRIVING
FIG.3K RESTART INSTRUCTION
St
t1
t2
t3
t4
t5
t6
t9
Δt
ΔT
N0
N1

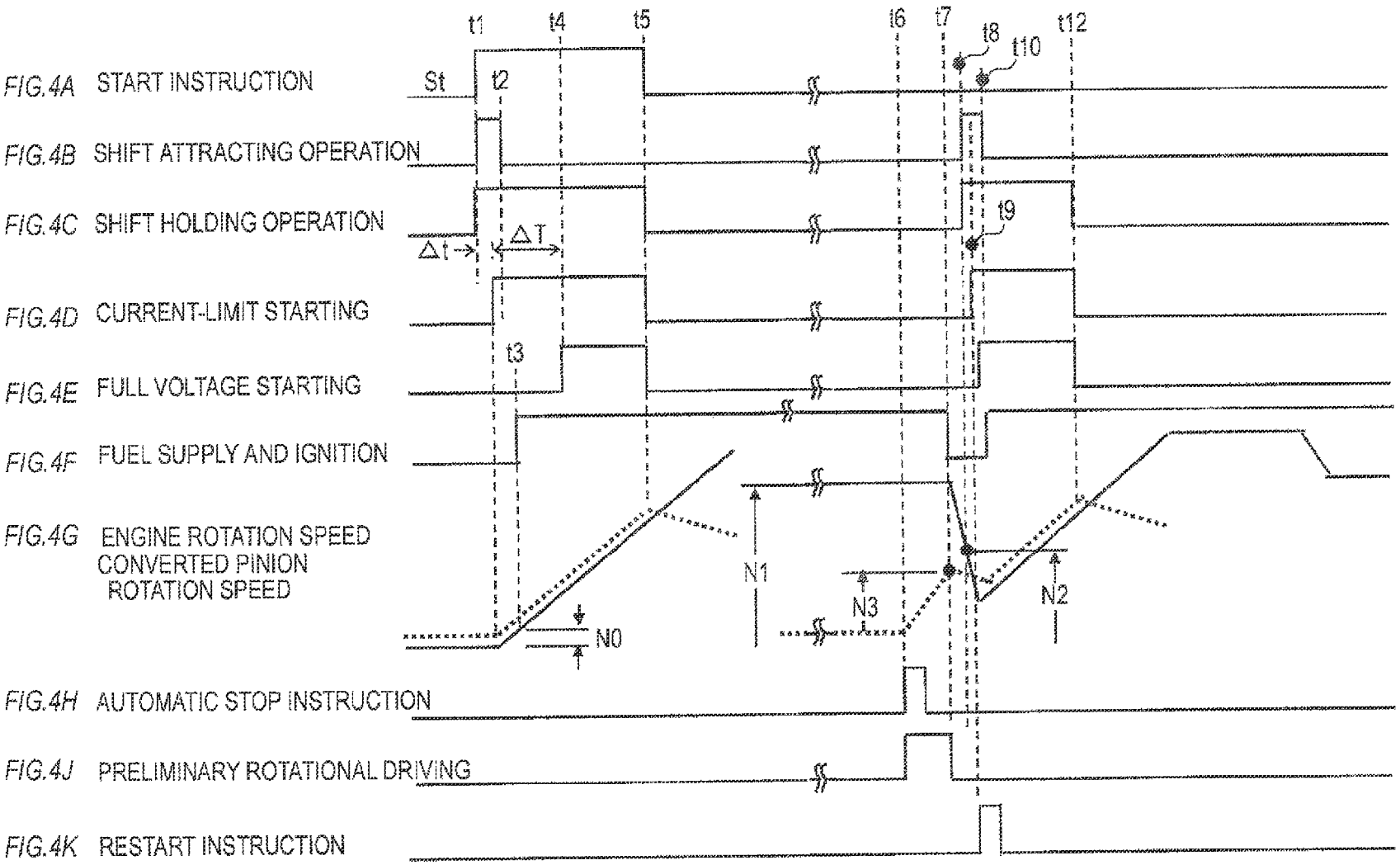
FIG.4A START INSTRUCTION
FIG.4B SHIFT ATTRACTING OPERATION
FIG.4C SHIFT HOLDING OPERATION
FIG.4D CURRENT-LIMIT STARTING
FIG.4E FULL VOLTAGE STARTING
FIG.4F FUEL SUPPLY AND IGNITION
FIG.4G ENGINE ROTATION SPEED
CONVERTED PINION
ROTATION SPEED
FIG.4H AUTOMATIC STOP INSTRUCTION
FIG.4J PRELIMINARY ROTATIONAL DRIVING
FIG.4K RESTART INSTRUCTION
St
t1
t2
t3
t4
t5
t6
t7
t8
t9
t10
t12
ΔT
Δt
N0
N1
N2
N3

IN-VEHICLE ENGINE START CONTROL APPARATUS

BACKGROUND OF THE INVENTION

1. Field of the Invention

The present invention relates to an in-vehicle engine start control apparatus that controls an engine to automatically stop and restart appropriately by avoiding a wasteful idle operation to improve fuel efficiency of an in-vehicle engine and suppress exhaust pollution.

2. Background Art

There is disclosed a wide variety of information related to an engine automatic stop and restart control apparatus configured to automatically stop an engine when a vehicle stops because an accelerator pedal returns to the original position and a brake pedal is depressed and to restart the engine because the brake pedal is released or the accelerator pedal is depressed. For example, a fuel consumption saving type automobile disclosed in Patent Document 1 adopts a start control apparatus that controls an engine to undergo inertial rotation by stopping fuel injection and releasing an exhaust valve when the engine is suspended. When an engine rotation speed is at least not 0, the start control apparatus runs a starter motor for a speed regulation operation and connects the starter motor to the engine after rotation speed thereof is synchronized with the engine rotation speed. The apparatus in the related art described in Patent Document 1 is configured to maintain inertial rotation of the engine to the extent possible during an automatic stop and to start a speed regulation operation of the starter motor after a restart request is issued to the engine that is gradually decelerating, so that a pinion gear on the side of the starter motor is synchronously meshed with a ring gear on the side of the engine.

An engine automatic stop and restart system disclosed in Patent Document 2 adopts a start control apparatus by which a pinion gear is rotationally driven by a starter in a case where a restart request is issued during an engine rotation decreasing period, that is, since the issuance of an automatic stop request until the engine rotation stops, and adjusts at least one of pushing timing and a pushing speed of the pinion gear by predicting a time when rotations of the pinion gear and the ring gear are synchronized with each other, so that cranking by the starter is started after the both gears are synchronously meshed with each other. The apparatus in the related art described in Patent Document 2 is configured to stop the engine as soon as possible during an automatic stop and enables the decelerating engine to restart in case of early issuance of a restart request under the assumption that a restart request may be issued while the engine is in a stopped state.

A starting apparatus for vehicle disclosed in Patent Document 3 adopts a start control apparatus that maintains a coupling between a pinion gear and a ring gear independently of the issuance of a restart request while an engine is in a stopped state according to an automatic stop request and restarts the engine by rotationally driving a starter as soon as a restart request is issued. The apparatus in the related art described in Patent Document 3, however, is silent about a case where the decelerating engine is restarted according to a restart request issued immediately after an automatic stop request.

For an in-vehicle engine starting apparatus, there is a technique to apply duty control to an electromagnetic shift coil, which drives a pinion gear to be pushed toward a ring gear, using a transistor. For example, according to a starter control method disclosed in Patent Document 4, an energization current is reduced after a predetermined time from a start of energization to an electromagnetic shift coil and before a time when a pinion gear and a ring gear are predicted to come into contact with each other. Accordingly, the pinion gear is allowed to come into contact with the ring gear smoothly while the energization current is adjusted appropriately in response to a power supply voltage during the predetermined time.

Regarding fuel injection control to start an engine quickly in an in-vehicle engine starting apparatus, there is an in-vehicle engine control apparatus disclosed, for example, in Patent Document 5. Herein, a discrimination portion that discriminates a cylinder sequence for fuel injection to a multi-cylinder engine is disclosed and a description is given to a concept of asynchronous fuel injection performed before the cylinder discrimination is completed and synchronous fuel injection performed after the cylinder discrimination is completed.

Patent Document 1: JP-A-2002-070699 (Paragraphs [0008], [0009], and [0024] in Specification, FIG. 3, and Abstract)
Patent Document 2: JP-A-2005-330813 (FIG. 1 and Abstract)
Patent Document 3: JP-A-2002-221133 (FIG. 1 and Abstract)
Patent Document 4: JP-A-2002-122059 (FIG. 2 and Abstract)
Patent Document 5: JP-A-2009-030543 (FIG. 2 and Abstract)

The start control apparatus of Patent Document 1 requires release control on the exhaust valve to let the engine undergo inertial operation. Hence, this start control apparatus has problems that the control mechanism becomes complex and expensive and that an auxiliary battery and a transistor having a large current capacity are required for the speed regulation operation by the starter motor. The start control apparatus of Patent Document 2 rotationally drives the starter motor preliminarily after an engine restart request is issued. Hence, it is difficult for the pinion gear and the ring gear to be synchronously meshed with each other while the engine is decelerating. Given these circumstances, the pinion gear is forcedly pushed in an asynchronous state or in many cases the engine is restarted after the engine stops completely. This start control apparatus therefore has problems that an unusual noise occurs, the pinion gear wears, and a delayed restart makes the driver feel unnatural.

The start control apparatus of Patent Document 3 does not restart the engine while the engine is decelerating. Hence, even in a case where the engine has to be restarted immediately after an automatic stop, it becomes necessary to wait until the engine stops completely. A delay thus occurred makes the driver feel unnatural. The engine decelerates quickly when fuel injection is stopped. However, an unstable rotation state including a reverse rotation operation occurs immediately before the engine stops completely. A time required for the engine to stop completely is by no means negligibly short for the driver wishing to start the vehicle quickly.

According to the pinion gear pushing control described in Patent Document 4, a time since the pinion pushing control is started until the pinion gear comes into contact with the ring gear varies with magnitude of the power supply voltage. This poses a problem that it is difficult to control the synchronous meshing. Also, the asynchronous fuel injection described in Patent Document 5 allows the engine decelerating by inertia to restart by itself without depending on a starting electric motor. Hence, the engine operates at an inappropriate air-fuel ratio, even temporarily, and there arises a problem that such an operation causes air pollution.

The apparatus described in Patent Document 5 temporarily suspends all the controls including the fuel injection and the cylinder sequence discrimination for initialization of a microprocessor in association with the occurrence of an abnormality during operation. Hence, in order to avoid the engine from decelerating to a low rotation region in which fuel injection timing is delayed due to a time required for cylinder sequence discrimination and the engine becomes unable to start by itself, asynchronous fuel injection is performed before the cylinder sequence discrimination is completed. In this manner, when the fuel injection is stopped, it is general to also stop the accompanying control on the cylinder sequence discrimination. It is therefore necessary to perform the cylinder sequence discrimination first when the fuel injection is resumed.

SUMMARY OF THE INVENTION

A first object of the invention is to provide an in-vehicle engine start control apparatus capable of quickly restarting an engine in response to a restart request issued at any moment after an engine automatic stop instruction is issued so that an unnatural feeling a driver may have due to a delayed start can be lessened.

A second object of the invention is to provide a simple preliminary rotational driving control unit of a pinion gear that allows the pinion gear to be synchronously meshed with a ring gear while the engine is decelerating.

An in-vehicle engine start control apparatus according to an aspect of the invention includes:

a starting electric motor unit having a DC electric motor driven with power fed from an in-vehicle battery, a pinion gear rotationally driven by the DC electric motor, and a pinion push mechanism allowing the pinion gear to couple to and decouple from a ring gear provided to a rotation shaft of an in-vehicle engine;

a rotational driving control circuit that controls driving of the DC electric motor; and an engine control apparatus that stops the in-vehicle engine by stopping a fuel injection instruction to a fuel injection electromagnetic valve when an automatic stop condition is satisfied while the in-vehicle engine is in an idle-rotation state, and restarts the in-vehicle engine by issuing a rotational driving instruction to the rotational driving control circuit and the fuel injection instruction to the fuel injection electromagnetic valve when a restart condition of the in-vehicle engine is satisfied.

The engine control apparatus includes a microprocessor that operates together with a program memory storing a control program constituting a fuel injection control unit.

The program memory further stores a control program constituting an engine rotation speed detection unit that operates correspondingly to an output of a rotation sensor detecting a rotation speed of the in-vehicle engine, a control program constituting a pinion rotation speed detection unit that operates correspondingly to a rotation sensor that detects the rotation speed of the pinion gear, or a rotation speed estimation unit that estimates a rotation speed of the pinion gear, and a control program constituting a preliminary rotational driving control unit that rotationally drives the pinion gear preliminarily, and a control program constituting a push driving control unit that issues a push driving instruction to the pinion push mechanism.

The microprocessor stops the fuel injection instruction when the automatic stop condition of the in-vehicle engine is satisfied, and restarts the in-vehicle engine in one of a inertial rotation state and a stopped state by starting preliminary rotational driving of the pinion gear using the preliminary rotational driving control unit in a vicinity of a time when fuel injection is stopped, before the rotation speed of the in-vehicle engine drops at least to a predetermined initial rotation speed even when the restart condition of the in-vehicle engine is not satisfied so as to drive the pinion gear to couple to the ring gear using the push driving control unit before the rotation speed of the in-vehicle engine drops to a predetermined lower limit rotation speed, and by issuing the rotational driving instruction and the fuel injection instruction under one of circumstances where the restart condition of the in-vehicle engine is already satisfied and where the restart condition is satisfied with a delay when coupling driving of the pinion gear is completed.

According to the in-vehicle engine start control apparatus configured as above, when the automatic stop condition of the in-vehicle engine occurs, the preliminary rotational driving of the pinion gear is performed without waiting for the restart condition to be satisfied, so that the coupling between the pinion gear and the ring gear is completed before the engine rotation speed that is dropping because fuel injection is stopped reaches the lower limit rotation speed at which an unstable rotation state starts to occur. Hence, in a case where the restart condition is satisfied while the in-vehicle engine is decelerating by inertia, it becomes possible to restart the engine immediately without waiting for the in-vehicle engine to stop completely by coming out from an unstable rotation range. Accordingly, there can be achieved an advantage that fuel-efficient driving is enabled without making the driver feel unnatural because of a delay of the restarting. Also, according to the in-vehicle engine start control apparatus configured as above, there is another advantage that it is not necessary to control opening of an exhaust valve of the in-vehicle engine. Moreover, there is still another advantage that it becomes possible to suppress a reduction of the wear life of the gears by coupling the pinion gear and the ring gear after rotation circumferential speeds of the both gears are approximated to each other while the in-vehicle engine is decelerating by inertia.

When a fuel supply to the in-vehicle engine is stopped because the automatic stop condition of the in-vehicle engine is satisfied, the engine quickly decelerates due to an air compression action inside the cylinders and stops completely by undergoing the unstable rotation range including a reverse rotation operation unless the exhaust valve of the in-vehicle engine is opened. Hence, in a case where the driver wishes to restart the engine by depressing the accelerator pedal while the engine is decelerating by inertia because the fuel supply is stopped as the automatic stop condition is satisfied, it is difficult to couple the pinion gear and the ring gear in the unstable rotation range. When the engine is restarted after waiting for the engine to stop completely, there is a problem that the driver feels unnatural due to a delay in response time. Also, in a rapid deceleration process before the engine rotation speed drops to the unstable rotation range, there is no sufficient time to rotationally drive the pinion gear after the restart request is issued. Accordingly, there is a problem that it is difficult to push the pinion gear after rotations of the pinion gear and the ring gear are synchronized with each other. However, these problems can be overcome by the in-vehicle engine start control apparatus configured as above.

The foregoing and other object, features, aspects, and advantages of the present invention will become more apparent from the following detailed description of the present invention when taken conjunction with the accompanying drawings.

BRIEF DESCRIPTION OF THE DRAWINGS

FIG. 2 is a time chart used to describe an operation in the in-vehicle engine start control apparatus according to the first embodiment of the invention when an engine is restarted by a starting electric motor unit after the engine stops completely;

FIG. 3 is a time chart used to describe an operation in the in-vehicle engine start control apparatus according to the first embodiment of the invention when the engine restarts by itself without depending on the starting electric motor unit immediately after an automatic stop instruction is issued;

FIG. 4 is a time chart used to describe an operation in the in-vehicle engine start control apparatus according to the first embedment of the invention when the engine is restarted by the starting electric motor unit while the engine is decelerating;

DESCRIPTION OF THE PREFERRED EMBODIMENTS

First Embodiment

Hereinafter, an in-vehicle engine start control apparatus according to a first embodiment of the invention will be described in detail.

(1) Detailed Description of the Configuration

Figure 1:
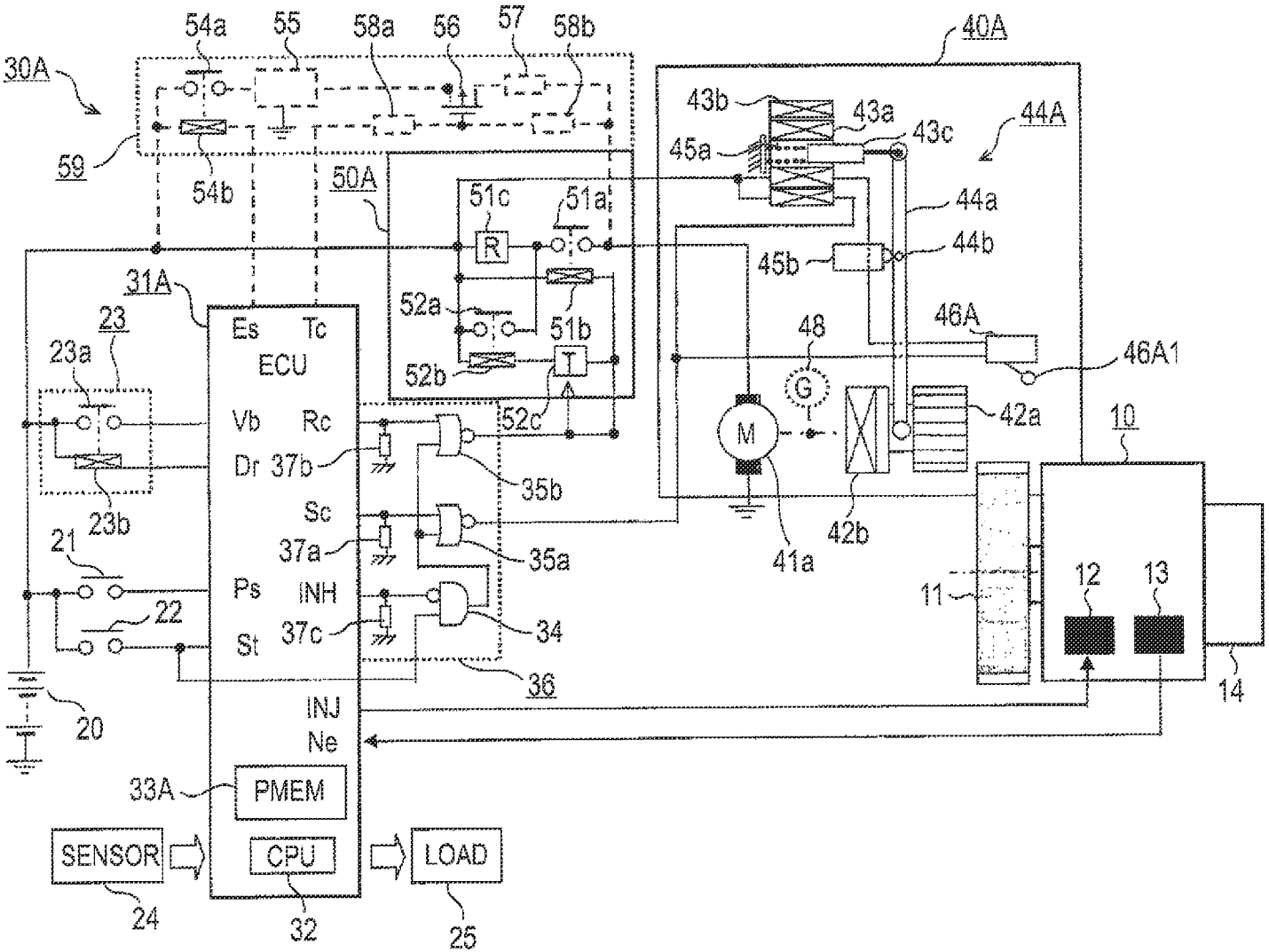
FIG. 1 is a view showing the overall configuration of an in-vehicle engine start control apparatus according to a first embodiment of the invention.

FIG. 1 is a view showing the overall configuration of the in-vehicle engine start control apparatus according to the first embodiment of the invention. Referring to FIG. 1, an in-vehicle engine start control apparatus 30A is formed of an engine control apparatus 31A, a starting electric motor unit 40A for a multi-cylinder in-vehicle engine 10, and a rotational driving control circuit 50A for the starting electric motor unit 40A.

The in-vehicle engine 10 is provided with a ring gear 11 serving also as a flywheel and provided to a rotation shaft thereof and contains therein a fuel injection electromagnetic valve 12 and a crank angle sensor serving as a rotation sensor 13. The in-vehicle engine 10 is configured to drive an unillustrated axle via a transmission 14. The engine control apparatus 31A contains therein a program memory 33A that operates together with a microprocessor 32 and is configured in such a manner that a power supply switch signal Ps and a manual start instruction signal St are inputted, respectively, from a power supply switch 21 and a start instruction switch 22 each connected to an in-vehicle battery 20 and operating correspondingly to opening and closing operations of the corresponding switch.

An output contact 23*a* in a power supply relay 23 forms a power feeding circuit and supplies power, which is a power supply voltage Vb, to the engine control apparatus 31A from the in-vehicle battery 20. A relay coil 23*b* in the power supply relay 23 is biased to close the output contact 23*a* as the power supply switch 21 is closed so that the microprocessor 32 starts to operate. Once the microprocessor 32 starts to operate, even when the power supply switch 21 is opened, a biased state of the relay coil 23*b* is maintained according to a power supply hold instruction Dr issued by the microprocessor 32.

A sensor group 24 for the engine control apparatus 31A includes switch sensors and analog sensors, such as a detection switch that detects depression of an accelerator pedal and a brake pedal, a shift switch that operates correspondingly to a selected position of a shift lever of the transmission 14, an accelerator position sensor that detects the degree of depression of the accelerator pedal, a throttle position sensor that detects an aperture of a throttle valve, and an exhaust gas sensor that detects an oxygen concentration in an exhaust gas. An output of the rotation sensor 13, which is a part of the sensor group 24, is inputted into the microprocessor 32 as an engine rotation signal Ne.

An electric load group 25 driven by the engine control apparatus 31A includes a throttle valve aperture control motor, a sparking coil for a gasoline engine, and a speed selection electromagnetic coil. Further, the fuel injection electromagnetic valve 12 is a part of the electric load group 25. A fuel injection instruction INJ is outputted to the fuel injection electromagnetic valve 12 from the engine control apparatus 31A. The starting electric motor unit 40A is formed of a DC electric motor 41*a* as a main body, a pinion gear 42*a* rotationally driven in one direction by the DC electric motor 41*a* via a one-way clutch 42*b*, and a pinion push mechanism 44A allowing the pinion gear 42*a* to mesh with and couple to a ring gear 11.

The pinion push mechanism 44A is formed of a shift lever 44*a* that swings about a movable supporting point 44*b*, a shift plunger 43*c* that is provided at one end of the shift lever 44*a* and moves leftward in the drawing by attraction when a shift attracting coil 43*a* and shift holding coil 43*b* are energized, a return spring 45*a* that drives the shift plunger 43*c* to return rightward in the drawing when the shift attracting coil 43*a* and the shift holding coil 43*b* are de-energized, and an accumulation spring 45*b* that completes an attraction operation of the shift plunger 43*c* as the movable supporting point 44*b* moves leftward in the drawing when tooth planes of the pinion gear 42*a* and the ring gear 11 come into contact with each other. The other end of the shift lever 44*a* is engaged in a rotatable manner with a spool that drives the pinion gear 42*a* to be pushed rightward in the drawing.

In a case where the movable supporting point 44*b* moves leftward in the drawing as the tooth planes of the pinion gear 42*a* and the ring gear 11 come into contact with each other when the shift plunger 43*c* is attracted leftward in the drawing because the shift attracting coil 43*a* and the shift holding coil 43*b* are energized, rotations of the pinion gear 42*a* cause the engaging position of the tooth plane of the pinion gear 42*a* and the tooth plane of the ring gear 11 to undergo displacement. Then, the pinion gear 42*a* and the ring gear 11 come into a state where they are allowed to mesh with each other. In this state, the movable supporting point 44*b* is forced to return rightward in the drawing by the accumulation spring 45*b* and meshed-coupling between the pinion gear 42*a* and the ring gear 11 is completed.

A meshing detection switch 46A is connected to the shift attracting coil 43*a* in series. When the meshed-coupling between the pinion gear 42*a* and the ring gear 11 is completed, a detection lever 46A1 is pressed against the end face of the pinion gear 42*a*. The mesh detection switch 46A therefore switches OFF to cut off an energization current to the shift attracting coil 43*a*. It is preferable to provide a rotation sensor 48 that detects a rotation speed of the pinion gear 42*a* to a rotation shaft of the DC electric motor 41*a*.

The rotational driving control circuit 50A is formed of an output contact 51*a* and a relay coil 51*b* in a current-limit starting relay of a normally-opened contact type, a current-limit starting resistor 51*c*, an output contact 52*a* and a relay coil 52*b* in a full voltage starting relay of a normally-opened contact type, and a current-limit starting timer 52*c*. The current-limit starting resistor 51*c* and the output contact 51*a* are connected in series between the in-vehicle battery 20 and the DC electric motor 41*a*. The current-limit starting resistor 51*c* and the output contact 52*a* are connected in parallel.

An output contact of the current-limit starting timer 52*c* and the relay coil 52*b* are connected in series. When the microprocessor 32 issues a rotational driving instruction Rc, the relay coil 51*b* in the current-limit starting relay is biased to close the output contact 51*a*. Accordingly, power is fed to the DC electric motor 41*a* from the in-vehicle battery 20 via the current-limit starting resistor 51*c* and the output contact 51*a*. Thereafter, the coil 52*b* in the full voltage starting relay is biased when the current-limit starting timer 52*c* counts a predetermined time. The current-limit starting resistor 51*c* is then short-circuited by the output contact 52*a*. Accordingly, a full voltage is supplied to the DC electric motor 41*a* from the in-vehicle battery 20 via a series circuit formed of the output contact 52*a* and the output contact 51*a*.

When the rotation speed of the DC electric motor 41*a* has reached or exceeds a predetermined rotation speed, the current-limit starting timer 52*c* stops counting immediately, so that the coil 52*b* in the full voltage starting relay is biased.

The output contact 52*a* in the full voltage starting relay may be connected in parallel to a series circuit formed of the current-limit starting resistor 51*c* and the output contact 51*a* in the current-limit starting relay. Alternatively, the current-limit starting resistor 51*c* may be connected downstream of the output contact 51*a* in the current-limit starting relay, that is, it may be connected to the output contact 51*a* on the side of the DC electric motor 41*a*.

It is preferable that the rotational driving control circuit 50A is provided with a preliminary driving control circuit 59 annexed thereto. The preliminary driving control circuit 59 is formed of a low-voltage power supply circuit 55, for example, a DC-to-DC converter, a low-voltage power supply relay that feeds power to the low-voltage power supply circuit 55 from the in-vehicle battery 20 by closing an output contact 54*a* when a coil 54*b* is biased, an opening and closing element 56, for example, a field effect power transistor, and a current-limiting driving resistor 57 that are connected in series between an output terminal of the low-voltage power supply circuit 55 and the DC electric motor 41*a*, and voltage dividing resistors 58*a* and 58*b* that supply the opening and closing element 56 with a gate voltage.

The preliminary driving control circuit 59 is configured in such a manner that the relay coil 54*b* is biased under control according to a low-voltage power supply driving instruction Es issued by the microprocessor 32 and that a conducting state of the opening and closing element 56 is controlled according to a preliminary rotational driving instruction Tc.

A manual starting preference circuit 36 contained in the engine control apparatus 31A is formed of a gate element 34, NOR elements 35*a* and 35*b*, and pull-down resistors 37*a*, 37*b*, and 37*c*. The pull-down resistors 37*a*, 37*b*, and 37*c* serve as biasing resistors connected to a ground circuit so as to set a logical level to "L" while the microprocessor 32 is not operating according to a manual start inhibiting instruction INH, a rotational driving instruction Rc, and a push driving instruction Sc issued by the microprocessor 32.

The gate element 34 supplies an AND output of a logical level at the output terminal of the start instruction switch and a negative logic of the manual start inhibiting instruction INH as a first input signal to each of the NOR elements 35*a* and 35*b*. The 2-input NOR elements 35*a* and 35*b* receive, respectively, inputs of the push driving instruction Sc and the rotational driving instruction Rc issued by the microprocessor 32 as a second input signal. The output logic level shifts to "L" when at least one input logic level shifts to "H" and the NOR elements 35*a* and 35*b* enables the push driving instruction Sc for the pinion push mechanism 44A and the rotational driving instruction Rc for the rotational driving control circuit 50A, respectively.

As the microprocessor 32 starts to operate on the normal power supply voltage Vb when the output contact 23*a* in the power supply relay 23 is closed because the power supply switch 21 is closed, the logic level of the manual start inhibiting instruction INH shifts to "H" whereas the output logic of the gate element 34 shifts to "L". However, when the start instruction switch 22 is closed, the logic level of the manual start instruction signal St shifts to "H". The microprocessor 32 thus issues the push driving instruction Sc first and issues the rotational driving instruction Rc after a predetermined time.

When the rotational driving instruction Rc is issued, the coil 51*b* in the current-limit starting relay is biased to close the output contact 51*a*. Accordingly, power is fed to the DC electric motor 41*a* via the current-limit starting resistor 51*c* and the output contact 51*a*. When the power supply voltage Vb is normal, the output contact 52*a* in the full voltage starting relay is eventually closed due to an operation of the current-limit starting timer 52*c* to start the DC electric motor 41*a* by the full voltage starting.

During cold starting when the in-vehicle battery 20 is excessively discharging, in a case where the power supply voltage Vb drops abnormally because of a starting current flowing to the DC electric motor 41*a* and the microprocessor 32 becomes unable to operate temporarily, the pull-down resistors 37*a*, 37*b*, and 37*c* respectively set the logic levels of the manual start inhibiting instruction INH, the push driving instruction Sc, and the rotational driving instruction Rc each issued by the microprocessor 32 to "L". However, by keeping the start instruction switch 22 closed, driving instructions from the gate element 34 to the pinion push mechanism 44A and the rotational driving control circuit 50A are maintained via the NOR elements 35*a* and 35*b*, respectively. In this manner, the DC electric motor 41*a* is started and when the power supply voltage Vb restores to a normal state because the starting current decreases as the rotation speed rises, the microprocessor 32 resumes the operation. Accordingly, the microprocessor 32 starts fuel injection control while issuing the push driving instruction Sc and the rotational driving instruction Rc and the engine 10 eventually becomes able to rotate by itself.

When the engine 10 goes into a self-rotating state, the microprocessor 32 issues the manual start inhibiting instruction INH and stops the push driving instruction Sc and the rotational driving instruction Rc. Consequently, even when the start instruction switch 22 is kept closed, it becomes possible to complete a starting operation of the engine 10. The same can be said in a case where the start instruction switch 22 is closed while the engine 10 is rotating. That is, it is configured in such a manner that the push driving instruction Sc and the rotational driving instruction Rc are stopped while the microprocessor 32 is operating normally.

(2) Detailed Description of Function and Operation

An operation of the in-vehicle engine start control apparatus 30A according to the first embodiment of the invention will now be described with reference to the drawings.

Firstly, a description will be given to an operation to restart the engine 10 using the starting electric motor unit 40A after the engine 10 is stopped completely. Referring to FIG. 1, when the power supply switch 21 is closed, the microprocessor 32 in the engine control apparatus 31A starts to operate. The microprocessor 32 drives the electric load group 25 including the fuel injection electromagnetic valve 12, the pinion push mechanism 44A, and the rotational driving control circuit 50A under control in a manner corresponding to an operation state of the sensor group 24 including the rotation sensor 13 and the content of the control program pre-written in the program memory 33A.

FIG. 2 is a time chart used to describe an operation of the in-vehicle engine start control apparatus 30A according to the first embodiment of the invention when the engine 10 is restarted using the starting electric motor unit 40A after the engine 10 stops completely. Herein, (A) of FIG. 2 represents a change of the logic level of the manual start instruction signal St inputted into the microprocessor 32. As is indicated by (A) of FIG. 2, when the start instruction switch 22 is closed at a time t1, the logic level shifts to "H" and when the start instruction switch 22 is opened at a time t5, the logic level shifts to "L".

Also, (B) and (C) of FIG. 2 respectively represent power feeding states of the shift attracting coil 43*a* and the shift holding coil 43*b* in the pinion push mechanism 44A. As are indicated by (B) and (C) of FIG. 2, as the microprocessor 32 issues the push driving instruction Sc correspondingly to the closing of the start instruction switch 22 at the time t1, the shift attracting coil 43*a* and the shift holding coil 43*b* are biased and the shift plunger 43*c* is attracted leftward in FIG. 1. As meshed-coupling between the pinion gear 42*a* and the ring gear 11 is performed at a time t2 and the meshing detection switch 46A is opened, the shift attracting coil 43*a* is de-energized whereas the shift holding coil 43*b* is kept biased. Accordingly, the shift plunger 43*c* is held at the attracted position.

It should be noted, however, that ON and OFF duty of the push driving instruction Sc is actually controlled correspondingly to the power supply voltage Vb. Hence, even when the power supply voltage Vb fluctuates, a substantially constant average voltage is applied to the shift attracting coil 43*a* and the shift holding coil 43*b*. Also, the average voltage is further controlled to be a suppressed voltage over a contact required time Δt required for the pinion gear 42*a* and the ring gear 11 to come into contact with each other. In addition, the shift holding coil 43*b* is de-energized at the time t5 when the start instruction switch 22 is opened.

It should be noted that the shift attracting coil 43*a* and the shift holding coil 43*b* are biased again at a time t8 at which the engine 10 is restarted after an automatic stop described below.

Also, (D) and (E) of FIG. 2 respectively represent an opening and closing operation state of the output contact 51*a* in the current-limit starting relay and the output contact 52*a* in the full voltage starting relay in the rotational driving control circuit 50A. As are indicated by (D) and (E) of FIG. 2, the coil 51*b* in the current-limit starting relay is biased to close the output contact 51*a* at a time [t1+Δt] when the contact required time has elapsed since the push driving operation was started. Also, the coil 52*b* in the full voltage starting relay is biased to close the output contact 52*a* at a time t4 when a current-limit starting time ΔT, which is a set time in the current-limit starting timer 52*c*, has elapsed. Further, at the starting completion time t5, the coil 51*b* in the current-limit starting relay and the coil 52*b* in the full voltage starting relay are de-energized to open the output contacts 51*a* and 52*a*, respectively.

It should be noted that current-limit starting relay and the full voltage starting relay operate in the same manner as above from a time t9 to a time t12 during which a restart request is issued after the in-vehicle engine 10 automatically stops.

Also, (F) of FIG. 2 represents a time zone during which the fuel injection control is performed. Referring to (F) of FIG. 2, the rotation speed of the in-vehicle engine 10 started by the current-limit starting by the DC electric motor 41*a* reaches a fuel injection start rotation speed N0 at a time t3. Then, fuel injection is started sequentially for the respective cylinders of the multi-cylinder engine 10 according to the cylinder sequence discriminated by a cylinder sequence discrimination unit. In a case where the in-vehicle multi-cylinder engine 10 is a gasoline engine, ignition control is performed for the injected fuel. Fuel injection is controlled in such a manner that the fuel injection is stopped at a time t7 described below according to an automatic stop request to the in-vehicle engine 10 and the fuel injection is resumed at a time t10 according to a restart request.

Also, (G) of FIG. 2 represents a rotation speed of the in-vehicle engine 10 by a solid line and a converted pinion rotation speed, that is, a rotation speed in terms of a circumferential speed ratio between the ring gear 11 and the pinion gear 42*a* by a dotted line. As is indicated by (G) of FIG. 2, when the rotation speed of the pinion gear 42*a* coincides with the rotation speed of the ring gear 11, that is, the rotation speed of the engine 10, a circumferential speed of the ring gear 11 coincides with a circumferential speed of the pinion gear 42*a* and this is the timing to push the ring gear 42*a* for synchronous meshing.

The converted pinion rotation speed is expressed by the following equation:

converted pinion rotation speed=rotation speed of pinion gear×(the number of teeth of pinion gear/the number of teeth of ring gear).

The converted pinion rotation speed increases as the current limiting starts at the time (t1+Δt) and keeps decreasing by inertia from the time t5 when the starting is completed until the pinion gear 42*a* stops. The engine rotation speed indicated by the sold line increases as the rotation speed of the DC electric motor 41*a* increases and eventually reaches a rotation speed corresponding to the degree of depression of the accelerator pedal while the engine 10 starts to rotate by itself. The engine rotation speed, however, drops to an idle rotation speed N1 before a time t6 when an automatic stop request is issued. The engine rotation speed shows the same rotation speed characteristics at and after a time t9 when a restart request is issued and an operation at the time t6 when the automatic stop request is issued will be described below.

Also, (H) of FIG. 2 represents an engine automatic stop request signal. As is indicated by (H) of FIG. 2, the engine automatic stop request signal is issued at the time t6 when the vehicle is in a stopped state because the vehicle speed drops to or below a lower limit threshold as the brake pedal is depressed and the accelerator pedal returns to the original position while an idle stop mode is selected.

It should be noted, however, the engine automatic stop request signal is generated under other conditions. The following are also taken into account as supplementary conditions. That is, the power supply voltage Vb of the in-vehicle battery 20 is at or above a predetermined value and the in-vehicle batter 20 is charged sufficiently to withstand frequent occurrences of the restarting, a temperature of the engine cooling water is at or above a predetermined value, and the engine 10 is in a stable heating operation state with the idle rotation speed staying at or below a predetermined value.

Also, (J) of FIG. 2 represents a preliminary rotational driving instruction signal for the pinion gear 42*a*. As is indicated by (J) of FIG. 2, the preliminary rotational driving instruction signal for the pinion gear 42*a* is generated correspondingly to the automatic stop request instruction signal generated at the time t6 and is therefore generated at the same time t6. This preliminary rotational driving instruction signal is the same as the rotational driving instruction Rc to the rotational driving control circuit 50A. Upon issuance of the rotational driving instruction Rc at the time t6, the coil 51*b* in the current-limit starting relay is biased to close the output contact 51*a* so that the DC electric motor 41*a* is started by the current-limit starting via the current-limit starting resistor 51*c*. The preliminary rotational driving instruction is removed at the time t7 when the converted pinion rotation speed represented by (G) of FIG. 2 rises to a preliminary driving rotation speed N3. The DC electric motor 41*a* thus starts to decelerate by inertia.

It should be noted, however, that in a case where the rotational driving control circuit 50A has the preliminary driving control circuit 59, the coil 54*b* in the low-voltage power supply relay is biased as an idle stop mode is selected and the low-voltage power supply circuit 55 generates a low-voltage output, for example, of DC 5 [V], by means of the output contact 54*a*. The opening and closing element 56 is then closed upon issuance of the preliminary rotational driving instruction Tc and the DC electric motor 41*a* is rotationally driven preliminarily via the current-limiting driving resistor 57.

The low-voltage power supply circuit 55 may be omitted by setting a large value to the current-limiting driving resistor 57 so that the output contact 54*a*, the opening and closing element 56, and the current-limiting driving resistor 57 are connected in series. In either case, with the use of the opening and closing element 56 formed of a power transistor, it becomes possible to start preliminary rotational driving of the DC electric generator 41*a* and release the driving by instantly responding to the preliminary rotational driving instruction Tc. Hence, there is a characteristic that the preliminary driving rotation speed N3 can be obtained precisely. The current-limiting driving resistor 57 is to suppress a rush current when the opening and closing element 56 is closed. However, in a case where the circuit driving control circuit 50A has the preliminary driving control circuit 59, the current-limiting driving resistor 57 may be omitted by designing the low-voltage power supply circuit 55 to have moderate internal impedance.

Referring to (F) and (G) of FIG. 2 again, when the preliminary rotational driving is completed at the time t7, fuel injection is stopped and the engine rotation speed decreases abruptly. At a time t8 when the engine rotation speed drops to a predetermined push rotation speed N2, as are indicated by (B) and (C) of FIG. 2, the shift attracting operation and the shift holding operation are performed and the pinion gear 42*a* is driven to be pushed.

Consequently, when the contact required time Δt of the pinion gear 42*a* has elapsed, the engine rotation speed coincides with the converted pinion rotation speed and synchronous meshing is performed. After the synchronous meshing between the pinion gear 42*a* and the ring gear 11 is performed, the shift attracting coil 43*a* is de-energized as is indicated by (B) of FIG. 2 whereas the shift holding coil 43*b* is kept in a biased state until a time t12 when the restarting is completed as is indicated by (C) of FIG. 2. Meanwhile, as is indicated by (G) of FIG. 2, the engine rotation speed keeps decreasing and the engine 10 eventually stops completely by undergoing an unstable rotation state including a reverse rotation operation.

Also, (K) of FIG. 2 represents an engine restart request instruction signal after the in-vehicle engine 10 stops completely. As is indicated by (K) of FIG. 2, the engine restart request instruction signal is generated at a time t9 when the brake pedal is released and the accelerator pedal is depressed after the in-vehicle engine 10 stops completely. When the restart request instruction signal is generated, the rotational driving instruction Rc is issued at the same time. Hence, as are indicated by (D) and (E) of FIG. 2, the current-limit starting relay and the full voltage starting relay start to operate sequentially and the restarting is completed at the time t12 as the current-limit starting relay and the full voltage starting relay are de-energized. As are indicated by (F) and (G) of FIG. 2, when the engine rotation speed reaches the fuel injection start rotation speed N0 during this period, the fuel injection control is resumed at the time t10.

A description will now be given to the engine restarting in a case where a restart request is issued early immediately after an automatic stop request is issued while the engine 10 is operating. FIG. 3 is a time chart used to describe an operation of the in-vehicle engine restart control apparatus 30A according to the first embodiment of the invention when the engine 10 restarts by itself without depending on the starting electric motor unit 40A immediately after an automatic stop instruction is issued. Because the operation involved with the initial starting is the same as that described with reference to FIG. 2, a description thereof is omitted in the following.

As with (A) of FIG. 2, (A) of FIG. 3 represents a generation state of the manual start instruction signal St. Likewise, As with (B) and (C) of FIG. 2, (B) and (C) of FIG. 3 represent power feeding states of the shift attracting coil 43*a* and the shift holding coil 43*b*, respectively. As with (D) and (E) of FIG. 2, (D) and (E) of FIG. 3 represent opening and closing operation states of the output contact 51*a* in the current-limit starting relay and the output contact 52*a* in the full voltage starting relay, respectively. As with (F) of FIG. 2, (F) of FIG. 3 represents a time zone during which the fuel injection control is performed. As with (G) of FIG. 2, (G) of FIG. 3 represents the engine rotation speed by a solid line and the converted pinion rotation speed by a dotted line and indicates that the circumferential speed of the ring gear 11 coincides with that of the pinion gear 42*a* when the both rotation speeds coincide with each other, that is, the timing to push the pinion gear 42*a* for synchronous meshing. As with (H) of FIG. 2, (H) of FIG. 3 represents the engine automatic stop request signal generated at the time t6.

As with (J) of FIG. 2, (J) of FIG. 3 represents an issuance state of the preliminary rotational driving instruction to the pinion gear 42*a* that operates correspondingly to the automatic stop request generated at the time t6. As with (K) of FIG. 2, (K) of FIG. 3 represents the engine restart request signal generated at the time t9. However, the time t9 when the restarting is requested herein occurs immediately after the time t6 when the automatic stop is requested. Hence, the preliminary rotational driving instruction indicated by (J) of FIG. 3 is stopped immediately at the time t9 and the converted pinion rotation speed starts to decrease by inertia before it reaches the predetermined preliminary driving rotation speed N3 as is indicated by (G) of FIG. 3. Because the fuel injection control represented by (F) of FIG. 3 is continuing, the engine rotation speed is maintained at the idle rotation speed and the engine 10 is in a state where it does not have to be restarted.

Even in a case where a restart request is issued with a slight delay and a restart request is issued after the fuel injection stopped because the converted pinion rotation speed has reached the preliminary driving rotation speed N3, the engine 10 is able to complete restarting without an aid of the starting electric motor unit 40A by merely resuming the fuel injection when the engine rotation speed is as high as or higher than a self-start rotation speed N4.

A description will now be given to the engine restarting in a case where a restart request is issued while the engine 10 is decelerating immediately after an automatic stop request is issued while the engine 10 is operating. FIG. 4 is a time chart used to describe an operation of the in-vehicle engine restart control apparatus 30A according to the first embodiment of the invention when the engine 10 is restarted using the starting electric motor unit 40A while the engine 10 is decelerating. Because the operation characteristics relating to the initial starting are the same as those described with reference to FIG. 2, a description thereof is omitted in the following.

Because (A) through (K) of FIG. 4 correspond to (A) through (K) of FIG. 2, respectively, a difference between FIG. 2 and FIG. 4 will be chiefly described. A fundamental difference between FIG. 4 and FIG. 2 is, as is obvious from comparison between (K) of FIG. 4 and (K) of FIG. 2, an occurrence point of the time t9 when the restart request is issued. In the case of (K) of FIG. 4, the time t9 when the restart request is issued occurs while the engine 10 is decelerating.

Hence, when the automatic stop request is issued at the time t6 as is indicated by (H) of FIG. 4, the preliminary rotational driving instruction is issued at the same time as is indicated by (J) of FIG. 4. Then, as is indicated by (G) of FIG. 4, the converted pinion rotation speed increases and reaches the predetermined preliminary driving rotation speed N3 at the time t7. Accordingly, as is indicated by (F) of FIG. 4, the fuel injection stops at the time t7 and the engine 10 starts to decelerate. As is indicated by (G) of FIG. 4, the engine rotation speed drops to the predetermined push rotation speed N2 at the time t8. As are indicated by (B) and (C) of FIG. 4, the push driving of the pinion gear 42*a* starts at the time t8 and the restart request instruction indicated by (K) of FIG. 4 is issued at the time t9, which is a suitable time when the pinion gear 42*a* and the ring gear 11 come into contact with each other. At the same time, the rotational driving instruction Rc is issued as is indicated by (D) of FIG. 4 and the current-limit starting relay is biased.

When the engine rotation speed exceeds a predetermined rotation speed corresponding to the preliminary driving rotation speed N3 of the pinion gear 42*a*, the current-limit starting timer 52*c* immediately stops counting. Hence, as is indicated by (E) of FIG. 4, the full voltage starting relay is biased without the current-limit starting time ΔT and the fuel injection is resumed subsequently as is indicated by (F) of FIG. 4.

In the example of the restarting described in accordance with the time chart of FIG. 3, the engine 10 does not need a starting aid of the DC electric motor 41*a* and restarts by merely resuming the fuel injection even when the engine 10 has already started decelerating. On the contrary, in the example of the restarting described in accordance with the time chart of FIG. 4, it is difficult for the engine 10 to restart by merely resuming the fuel injection without the starting aid of the DC electric motor 41*a* because the engine has decelerated further. For ease of description, this example corresponds to a case where the restart request is issued at or after the time t8. It should be noted, however, that in a case where the engine rotation speed has dropped to or below the injection start rotation speed N0, as in the example case of the restarting described in accordance with the time chart of FIG. 2, it becomes necessary to discriminate the cylinder sequence before the fuel injection is started.

Figure 5:
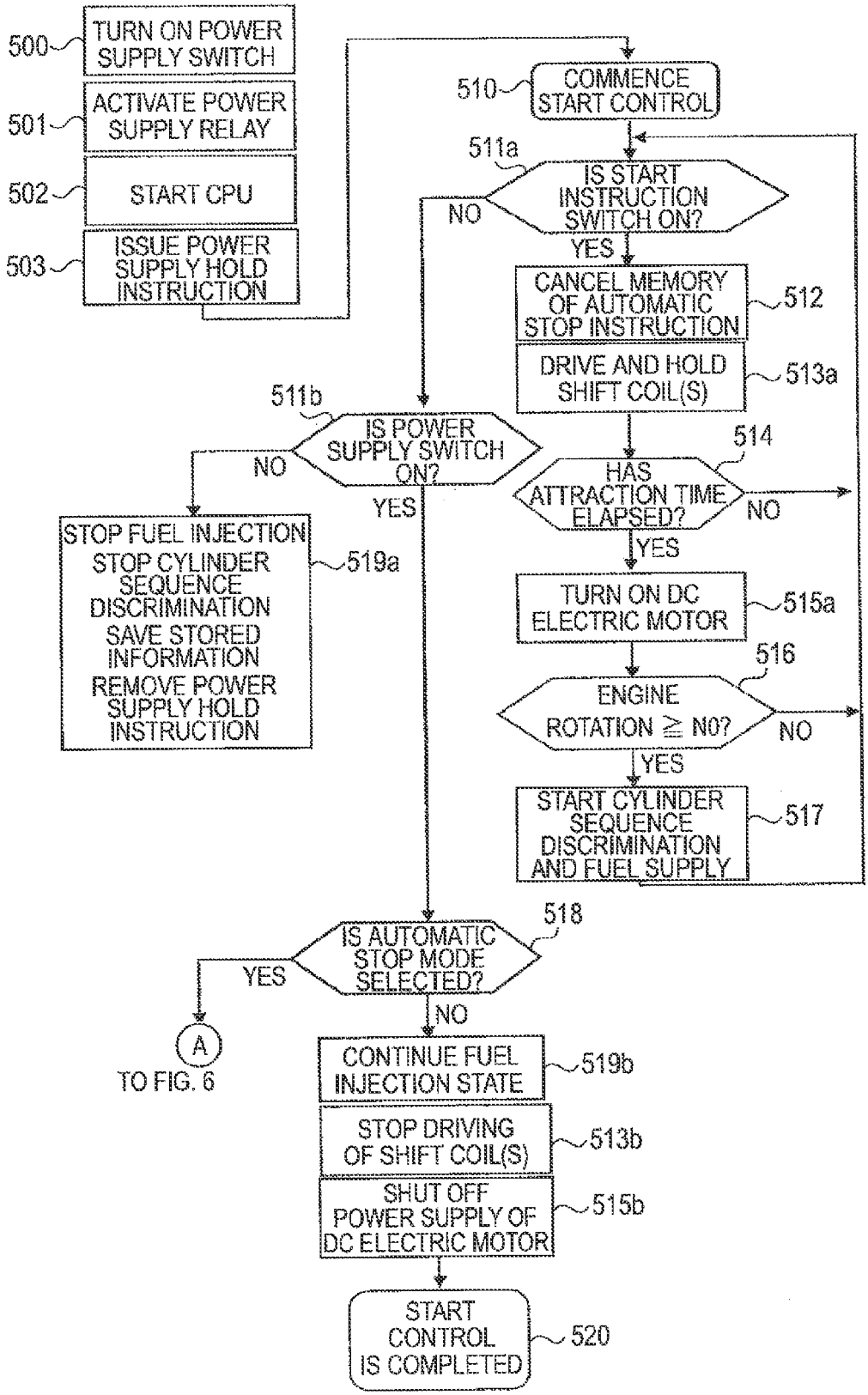
FIG. 5 is a first flowchart chiefly depicting an operation involved with manual start control in the in-vehicle engine start control apparatus according to the first embodiment of the invention.
Figure 6:
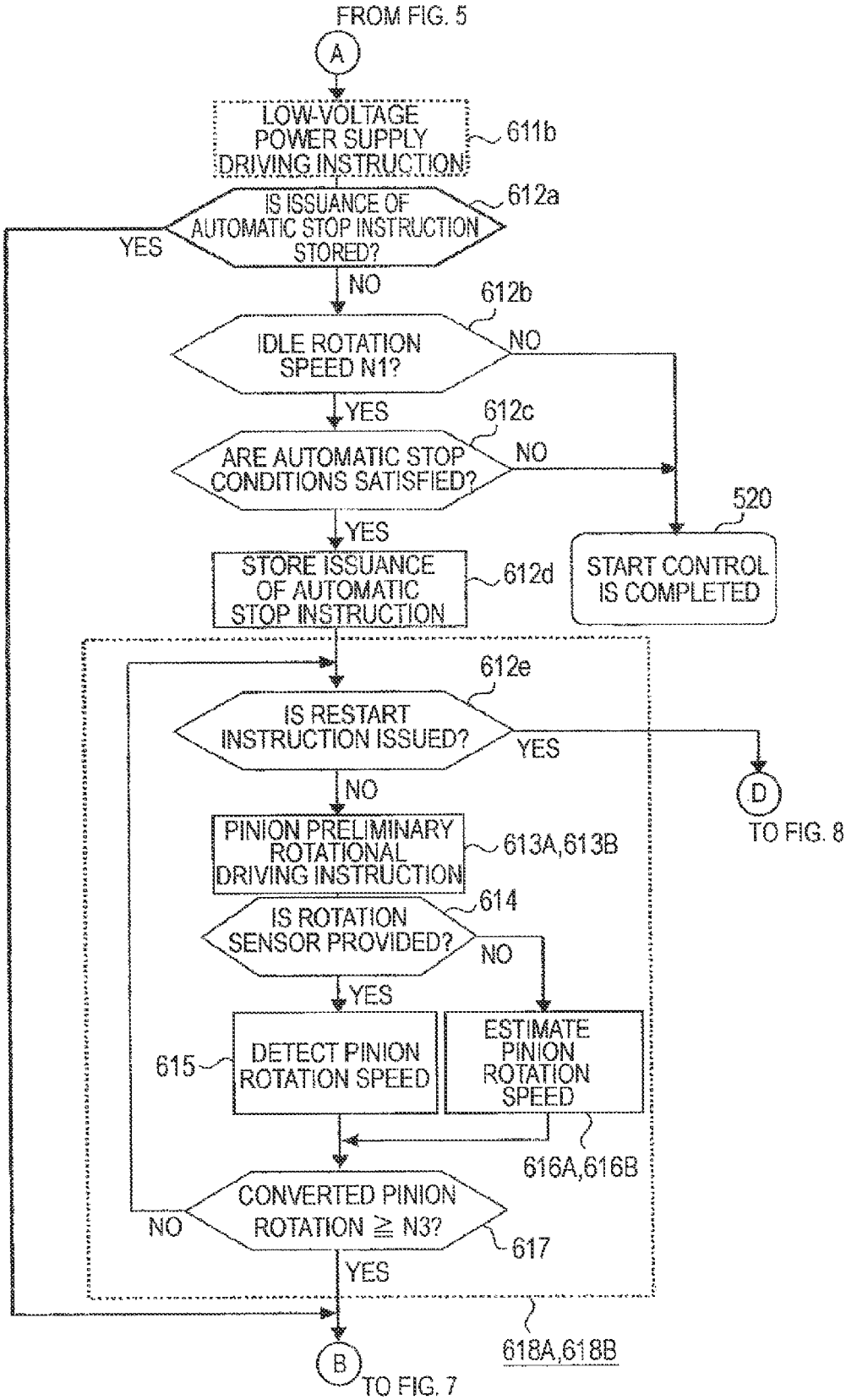
FIG. 6 is a second flowchart continued from the first flowchart of FIG. 5 and chiefly depicting an operation involved with preliminary rotational driving control on a pinion gear in the in-vehicle engine start control apparatus according to the first embodiment of the invention.
Figure 7:
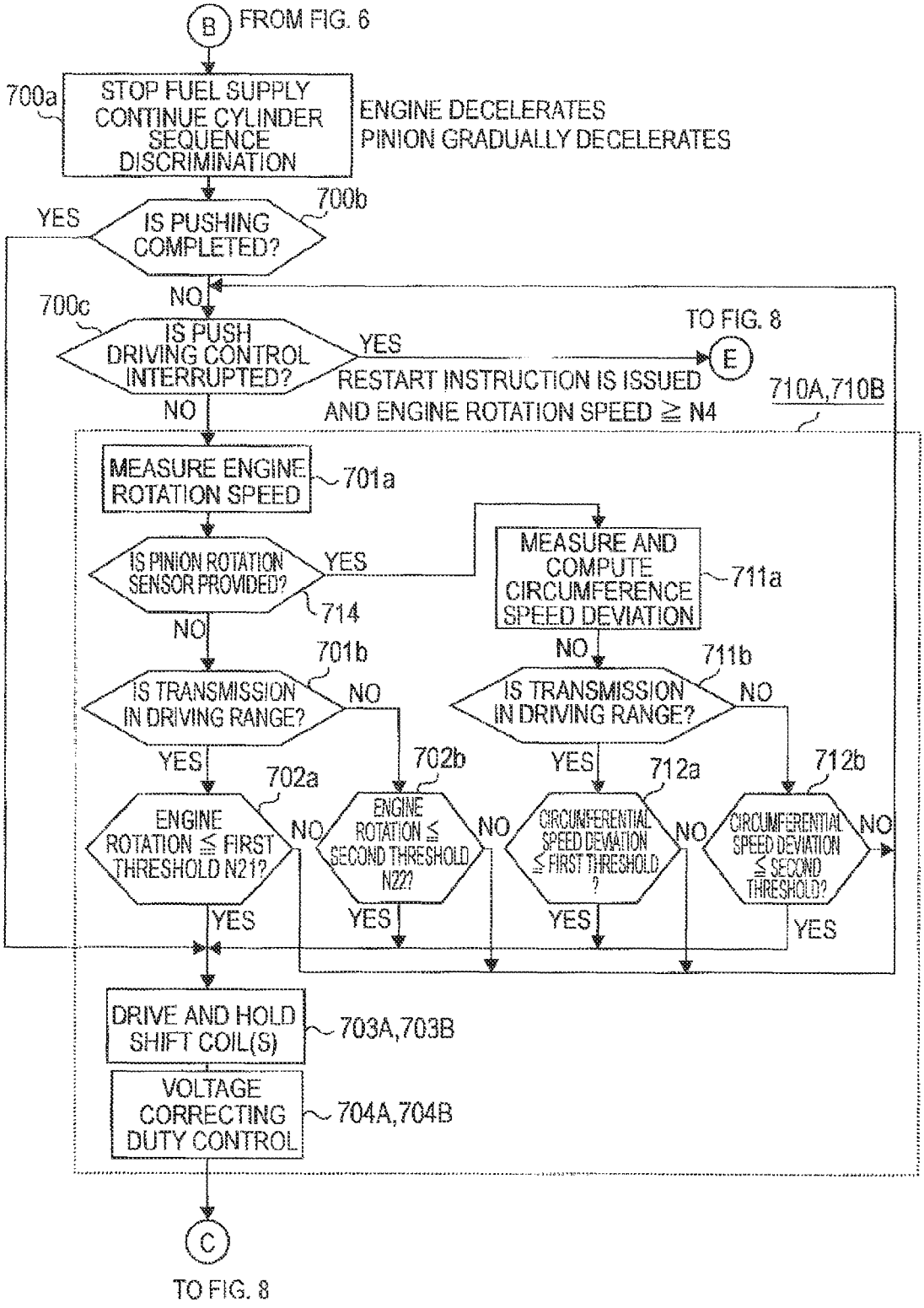
FIG. 7 is a third flowchart continued from the second flowchart of FIG. 6 and chiefly depicting an operation involved with push driving control on the pinion gear in the in-vehicle engine start control apparatus according to the first embodiment of the invention.
Figure 8:
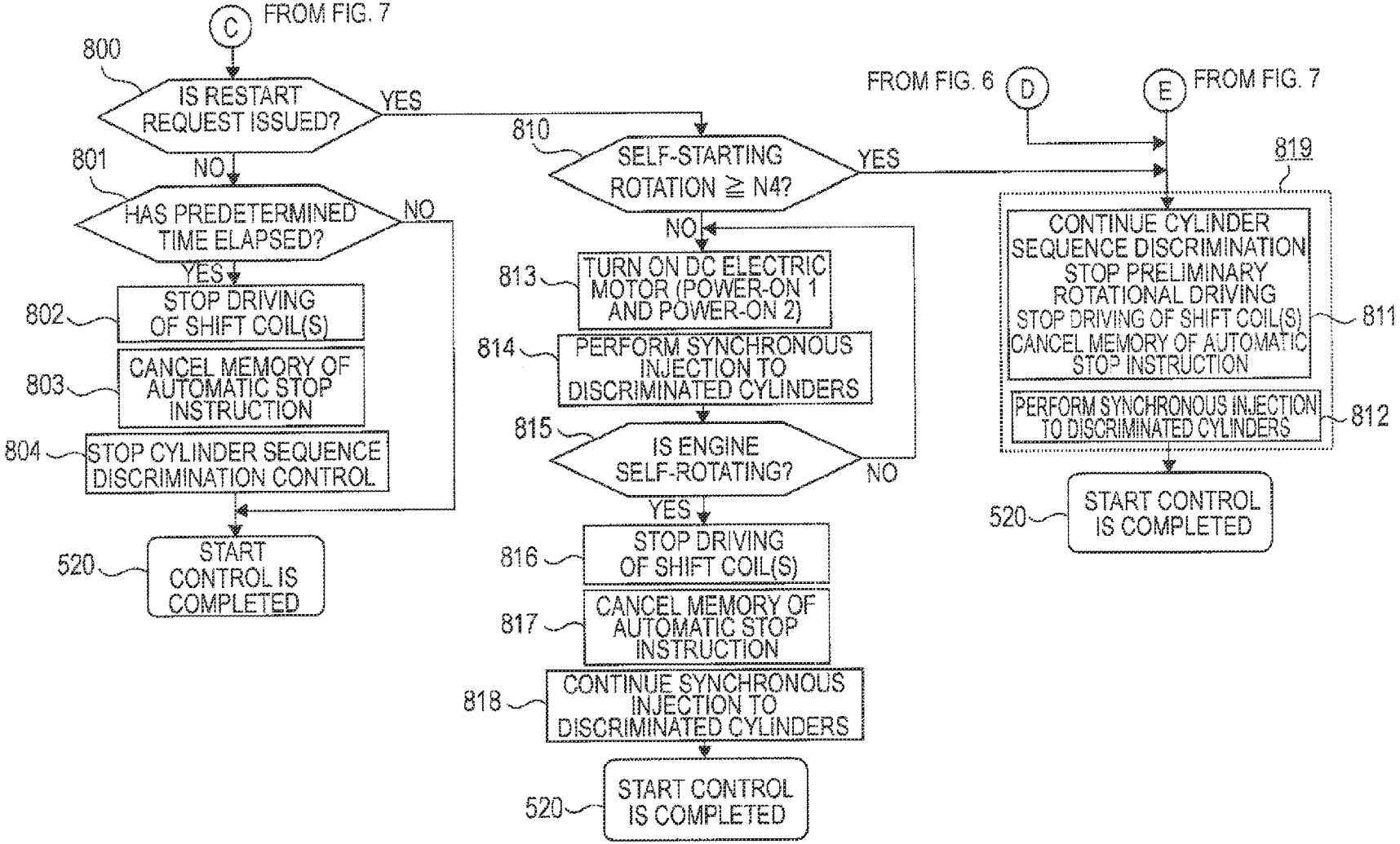
FIG. 8 is a fourth flowchart continued from the third flowchart of FIG. 7 and chiefly depicting an operation involved with restart control in the in-vehicle engine start control apparatus according to the first embodiment of the invention.

An operation of the in-vehicle engine start control apparatus 30A according to the first embodiment of the invention configured as above will now be described using the flowcharts. FIG. 5 through FIG. 8 are flowcharts used to describe an operation of the in-vehicle engine start control apparatus 30A according to the first embodiment of the invention. FIG. 5 is a first flowchart chiefly depicting an operation involved with the manual start control. FIG. 6 is a second flowchart chiefly depicting an operation involved with the preliminary rotational driving control on the pinion gear 42*a*. FIG. 7 is a third flowchart chiefly depicting an operation involved with the push driving control on the pinion gear 42*a*. FIG. 8 is a fourth flowchart chiefly depicting an operation involved with the restart control.

Referring to FIG. 5 and also FIG. 1 when the need arises, the power supply switch 21 is manually closed first in Step 500. In subsequent Step 501, the output contact 23*a* is closed as the power supply relay 23 is biased in association with the closing of the power supply switch 21. In subsequent Step 502, power is fed to the engine control apparatus 31A. The power is then fed to the microprocessor 32 via an unillustrated constant voltage power supply circuit and the microprocessor 32 starts the control operation. In subsequent Step 503, the microprocessor 32 issues the power supply hold instruction Dr and controls the power supply relay 23 to hold the power supply by itself.

In subsequent Step 510, the microprocessor 32 starts the engine start control operation. Subsequently, in Step 511*a*, whether the start instruction switch 22 is closed and the manual start instruction signal St is inputted in the microprocessor 32 is determined. In a case where the start instruction switch 22 is closed and the manual start instruction signal St is inputted in the microprocessor 32, the determination made herein is "YES" and the flow proceeds to Step 512. In a case where the start instruction switch 22 is opened and the manual start instruction signal St is not inputted in the microprocessor 32, the determination made herein is "NO" and the flow proceeds to Step 511*b*.

When the flow proceeds to Step 511*b*, whether the power supply switch 21 is closed and the power supply switch signal Ps is inputted in the microprocessor 32 is determined. In a case where the power supply switch 21 is closed, the determination made herein is "YES" and the flow proceeds to Step 518. In a case where the power supply switch 21 is opened, the determination made herein is "NO" and the flow proceeds to Step 519*a*.

In Step 518, whether the selection switch for an automatic stop mode, that is, an idle stop control mode, is closed is determined. In a case where the idle stop control mode is selected, the determination made herein is "YES" and the flow proceeds to Step 611*b* of FIG. 6 described below by way of a node A. In a case where the idle stop control mode is not selected, the determination made there is "NO" and the flow proceeds to Step 519*b* described below.

Selection of the selection switch for the idle stop mode is made using an exclusive-use manual operation switch or automatically according to a shift range of the transmission 14. For example, it may be configured in such a manner that an idle stop is enabled in a forward drive range D and a neutral range N whereas an idle stop is disabled in a reverse range R and a parking range P.

When the flow proceeds to Step 519*a* from Step 511*b* according to the determination result, "NO", the fuel injection control and the cylinder sequence discrimination control are stopped. Also, learning and memory information and abnormality occurrence history information during the operation are transferred to an unillustrated non-volatile data memory and saved therein. Thereafter, the power supply hold instruction Dr is removed. Accordingly, the power supply relay 23 is de-energized and the engine control apparatus 31A stops an operation.

As the flow proceeds to Step 519*b* according to the "NO" determination in Step 518, the fuel injection state is continued. In a case where fuel injection has started in Step 517 described below, the injection state is maintained. Subsequently, in Step 513*b*, in a case where the shift attracting coil 43*a* and the shift holding coil 43*b* are biased in another step, these coils are de-energized and the flow proceeds to Step 515*b*. In Step 515*b*, in a case where power is fed to the DC electric motor 41*a* in another step, the power feeding is cancelled and the flow proceeds to Step 520 in which the operation is ended. In Step 520, after other control operations are performed and within a predetermined time, for example, about 10 [msec], the flow proceeds again to Step 510 in which the operation starts.

When the flow proceeds to Step 512 according to the determination in Step 511*a* that the start instruction switch 22 is ON ("YES" determination), a memory of an automatic stop instruction stored in Step 612*d* described below is cancelled and the flow proceeds to Step 513*a*. In Step 513*a*, the push driving instruction Sc is issued and the shift attracting coil 43*a* and the shift holding coil 43*b* are biased. The flow then proceeds to Step 514.

When the flow proceeds to Step 514, whether a suitable time required for the pinion gear 42*a* to come into contact with the ring gear 11 by the push-driving has elapsed is determined. In a case where such a time has not elapsed yet, the determination made herein is "NO" and the flow returns to Step 511*a*. In a case where such a time has elapsed, the determination made herein is "YES" and the flow proceeds to Step 515*a*. In Step 515*a*, the rotational driving instruction Rc is issued to supply the DC electric motor 41*a* with power via the rotational driving control circuit 50A. In subsequent Step 516, whether the engine rotation speed has reached the injection start rotation speed N0 (for example, 200 to 300 [rpm]) is determined. In a case where the engine rotation speed has reached the injection start rotation speed NO, the determination made herein is "YES" and the flow proceeds to Step 517. Otherwise, the determination made herein is "N0" and the flow returns to Step 511*a*.

In Step 517, after the cylinder sequence to perform sequential fuel injection and ignition control on the in-vehicle engine 10 formed of a multi-cylinder engine is discriminated, fuel injection control is started and the flow returns to Step 511*a*. In a case where the engine starts to rotate by itself or a manual starting operation is interrupted, the start instruction switch 22 is opened. Accordingly, the determination made in Step 511*a* is "NO" and the flow proceeds to Step 511*b* described above.

Step 513*a* corresponds to (B) and (C) of FIG. 2 at the time t1. Step 515*a* corresponds to (D) of FIG. 2 at the time (t1+Δt). Step 517 corresponds to (F) of FIG. 2 at the time t3. However, until the engine 10 starts to rotate by itself, the flow circulates from Step 511*a* to Step 517 and during this circulation, (E) of FIG. 2 representing the full voltage starting is started at the time t4. When the start instruction switch 22 represented by (A) of FIG. 2 is opened at the time t5, the determination made in step 511*a* becomes "NO". Thereafter, the flow circulates from Steps 510, 511*a*, 511*b*, 518, 519*b*, 513*b*, 515*b*, 520, to 510 and waits for the automatic stop mode to be selected in Step 518.

A description will now be given to a case where the flow proceeds to Step 611*b* of FIG. 6 by way of the node A according to the determination result in Step 518 that the selection switch of the automatic stop mode, that is, the idle stop control mode is closed ("YES" determination). Referring to FIG. 6, Step 611*b* is performed when the determination made in Step 518 of FIG. 5 is "YES" as described above. In a case where the preliminary driving control circuit 59 is annexed to the rotational driving control circuit 50A, the low-voltage power supply driving instruction Es is issued and the flow proceeds to the following Step 612*a*.

In Step 612*a*, whether the issuance of the automatic stop instruction is stored in Step 612*d* described below is determined. In a case where the issuance of the automatic stop instruction is already stored, the determination made herein is "YES". The flow then proceeds to Step 700*a* of FIG. 7 described below via a node B. In a case where the automatic stop instruction has not been issued yet, the determination made herein is "NO" and the flow proceeds to Step 612*b*.

In Step 612*b*, whether the engine rotation speed is within a range of a predetermined idle rotation speed N1 (for example, 600 to 700 [rpm]) is determined. In a case where the engine rotation speed is within the idle rotation range, the determination made herein is "YES" and the flow proceeds to Step 612*c*. In a case where the engine rotation speed is out of the idle rotation range, the determination made herein is "NO" and the flow proceeds to Step 520 in which the operation is ended. When the flow proceeds to Step 612*c*, whether the automatic stop conditions are satisfied is determined. In a case where the automatic stop conditions are not satisfied, the determination made herein is "NO" and the flow proceeds to Step 520 where the operation is ended. In a case where the automatic stop conditions are satisfied, the determination made herein is "YES" and the flow proceeds to Step 612*d*.

In Step 612*d*, an automatic stop instruction is issued and the flow proceeds to Step 612*e* after the issuance of the automatic instruction is stored. When the flow proceeds to Step 612*e*, whether a restart instruction has been issued is determined. In a case where the restart instruction has been issued, the determination made herein is "YES" and the flow proceeds to Step 811 of FIG. 8 described below via a node D. Otherwise, the determination made herein is "NO" and the flow proceeds to Step 613A.

In Step Block 618A made up of Step 612*e* through Step 617, Step 613A and Step 616A relates to the first embodiment of the invention shown in FIG. 1 whereas Step Block 618B including Step 613B and 616B relates to a second embodiment of the invention described below with reference to FIG. 9.

In Step 613A, the preliminary rotational driving instruction is issued and then the flow proceeds to Step 614. The term, "preliminary rotational driving instruction", referred to herein means the preliminary rotational driving instruction Tc to the opening and closing element 56 in a case where the preliminary driving control circuit 59 is annexed to the rotational driving control circuit 50A whereas it also means the rotational driving instruction Rc as the preliminary rotational driving instruction to the rotational driving control circuit 50A in a case where the preliminary driving control circuit 59 is not annexed thereto.

The rotational driving instruction Rc is to rotationally drive the in-vehicle engine 10 when the shifting operation of the pinion gear 42*a* is completed in Step 515*a* of FIG. 5 described above and in Step 813 of FIG. 8 described below. It should be noted, however, that the rotational driving instruction Rc in Step 613A is an instruction to drive the pinion gear 42*a* solely in a step prior to the shifting operation of the pinion gear 42*a*.

Step 614 is a determination step from which the flow proceeds to Step 615 or Step 616A depending on whether the rotation sensor 48 is provided for the pinion gear 42*a*. In practice, in a case where the rotation sensor 48 is provided, Step 615 alone is performed by skipping Step 614 and Step 616A. In a case where the rotation sensor 48 is not provided, Step 616A alone is performed by skipping Step 614 and Step 615.

In Step 615, the rotation speed of the pinion gear 42*a* is detected on the basis of a frequency or an inverse of pulse intervals of a pulse signal the rotation sensor 48 generates and the converted pinion rotation number in terms of a circumferential speed of the ring gear 11 is calculated through computation. In Step 616A, a current rotation speed is estimated on the basis of a current power feeding time and a value of the power supply voltage according to standard characteristics obtained by measuring a relative relation between the feeding time and the rotation speed of the DC electric motor 41*a* using the power supply voltage as a parameter and the converted pinion rotation number in terms of the circumferential speed of the ring gear 11 is calculated through computation.

In Step 617 following Step 615 or Step 616A, whether the converted rotation speed of the pinion gear 42*a* has reached the preliminary driving rotation speed N3 (for example, 300 to 400 [rpm]) of (G) of FIG. 2 as the target is determined. In a case where the converted rotation speed has not reached the target rotation speed, the determination made herein is "NO". Then, the flow returns to Step 612*e* to continue the preliminary rotational driving. When the converted rotation speed reaches the target rotation speed, the determination made herein becomes "YES" and the flow proceeds to Step 700*a* of FIG. 7 via a relay terminal B. Herein, the "YES" determination made in Step 612*e* corresponds to (J) and (K) of FIG. 3 at the time t9 when the preliminary rotational driving is interrupted and the engine 10 restarts by itself.

Herein, Step 517 of FIG. 5 is a step representing a control program constituting a fuel injection control unit. Likewise, Step 613A, Step 615, step 616A, and Step block 618A of FIG. 6 are steps representing control programs constituting a preliminary rotational driving instruction unit, a pinion rotation speed detection unit, a pinion rotation speed estimation unit, and a preliminary rotational driving control unit, respectively.

An operation involved with the push driving control on the pinion gear 42*a* will now be chiefly described. Referring to FIG. 7, Step 700*a* is a step performed following a case where either the determination made in Step 612*a* of FIG. 6 is "YES" and the preliminary rotational driving in Step Block 618A is already performed or the determination made in Step 617 is "YES" and the preliminary rotational driving is ended. Hence, although the fuel injection is stopped, the cylinder sequence discrimination control is continued. Accordingly, as represented by (G) of FIG. 2 from the time t7 to the time t8, the engine rotation speed starts to decrease while the rotation speed of the pinion gear 42*a* for which the preliminary rotational driving is stopped keeps gradually decreasing by inertia.

In subsequent Step 700*b*, whether the push driving on the pinion gear 42*a* was performed in Step 703A described below 703A is determined. In a case where this is an initial operation where the push driving has not been performed yet, the determination made herein is "NO" and the flow proceeds to step 700*c*. In a case where Step 700*b* is performed after the push driving was already performed, the determination made herein is "YES" and the flow proceeds to Step 703A. Step 700*c* is a determination step in which to determine whether the push driving of the pinion gear 42*a* is interrupted. In a case where the restart instruction is issued when the engine rotation speed is as high as or higher than the self-start rotation speed N4 and an aid of the starting electric motor unit 40A is unnecessary, the determination made herein is "YES". The flow then proceeds to Step 811 of FIG. 8 via a node E. In a case where either the restart instruction is not issued or the engine rotation speed is lower than the self-start rotation speed N4 and an aid of the starting electric motor unit 40A is necessary, the determination made herein becomes "NO" and the flow proceeds to Step 701*a*.

In Step 701*a*, the rotation speed of the engine 10 is detected on the basis of a frequency or an inverse of pulse intervals of a pulse signal generated from the engine rotation sensor 13, which is, for example, a crank angle sensor. In subsequent Step 714, whether the rotation sensor 48 is provided for the pinion gear 42*a* is determined. Depending on the determination result herein, either Step 711*a* through Step 712*b* or Step 701*b* through Step 702*b* are performed. In practice, in a case where the rotation sensor 48 is provided, Step 711*a* through Step 712*b* are performed by skipping Step 714 through Step 702*b*. In a case where the rotation sensor 48 is not provided, Step 701*b* through Step 702*b* are performed by skipping Step 714 through Step 712*b*.

In Step 711*a* following Step 701*a*, in a case where the rotation sensor 48 is provided for the pinion gear 42*a*, a circumferential speed deviation proportional to a deviation between the engine rotation speed detected in Step 701*a* and the converted rotation speed of the pinion gear 42*a* calculated through computation in Step 615 of FIG. 6 is calculated through computation. In subsequent Step 711*b*, in a case where the selected range of the transmission 14 is a vehicle driving range, the determination made herein is "YES" and the flow proceeds to Step 712*a*. In a case where the selected range is a non-driving range, the determination made herein is "NO" and the flow proceeds to Step 712*b*. In Step 712*a*, whether the circumferential speed deviation calculated in Step 711*a* has dropped to or below a first threshold deviation speed is determined. In a case where the circumferential speed deviation is as high as or lower than the first threshold deviation speed, the determination made herein is "YES" and the flow proceeds to Step 703A. Ina case where the circumferential speed deviation is higher the first threshold deviation speed, the flow returns to Step 700*c* to wait for the circumferential speed deviation to drop.

In Step 712*b*, whether the circumferential speed deviation calculated in Step 711*a* has dropped to or below a second threshold deviation speed is determined. In a case where the circumferential speed deviation is as high as or lower than the second threshold deviation speed, the determination made herein is "YES" and the flow proceeds to Step 703A. In a case where the circumferential speed deviation is higher than the second threshold deviation speed, the flow returns to Step 700*c* to wait for the circumferential speed deviation to drop.

For example, assume that the conditions for an automatic stop are satisfied when the selected range of the transmission 14 is the forward drive range D or the neutral range N and the automatic stop is not performed when the selected range is the reverse range R or the parking range P. Then, the determination made in Step 711*b* is "YES" when the selected range is the drive range D and "NO" when the selected range is the neutral range N. Because the engine 10 decelerates by inertia more rapidly when the drive range D is selected than when the neutral range N is selected, the first threshold deviation speed is set to a higher rotation speed than the second threshold deviation speed.

In a case where the rotation sensor 48 is not provided for the pinion gear 42*a*, the determination made in Step 701*b* following Step 701*a* is "YES" in a case where the selected range of the transmission 14 is a vehicle driving range and the flow proceeds to Step 702*a*. The determination made herein is "NO" in a case where the selected range is a non-driving range and the flow proceeds to Step 702*b*. In Step 702*a*, whether the engine rotation speed calculated in Step 701*a* has dropped to or below a first threshold rotation speed N21 is determined. In a case where the engine rotation speed is as high as or lower than the first threshold rotation speed N21, the determination made herein is "YES" and the flow proceeds to Step 703A. Otherwise, the determination made herein is "NO" and the flow returns to Step 700*c* to wait for the rotation speed to drop.

In Step 702*b*, whether the engine rotation speed calculated in Step 701*a* has dropped to or below a second threshold rotation speed N22 is determined. In a case where the engine rotation speed is as high as or lower than the second threshold rotation speed N22, the determination made herein is "YES" and the flow proceeds to Step 703A. Otherwise, the flow returns to Step 700*c* to wait for the rotation speed to drop. For example, the first threshold rotation speed N21 is 550 [rpm] and the second threshold rotation speed N22 is 500 [rpm] and a higher rotation speed is set to the first threshold rotation speed.

In Step 703A, the push driving instruction Sc is issued to bias the shift attracting coil 43*a* and the shift holding coil 43*b*. In subsequent Step 704A, ON and OFF states of the push driving instruction Sc are switched so that the conducting duty takes a value inversely proportional to the value of the power supply voltage Vb of the in-vehicle battery 20. Owing to this switching operation, a voltage applied to the shift attracting coil 43*a* and the shift holding coil 43*b* is maintained at a constant value. Step 704A corresponds to a voltage correction unit that keeps the contact required time Δt of the pinion gear 42*a* and the ring gear 11 constant.

The push rotation speed N2 represented by (G) of FIG. 2 is either one of the two types of rotation speeds determined in the Step 702*a* and Step 702*b*. Step 703A corresponds to (B) and (C) of FIG. 2 at the time t8.

Further, in Step Block 710A made up of Step 701*a* through Step 704A, Step 703A and Step 704A relates to the first embodiment of the invention shown in FIG. 1 whereas Step Block 710B including Step 703B and Step 704B relates to the second embodiment of the invention described below with reference to FIG. 9.

An operation involved with the restart control will now be chiefly described. Referring to FIG. 8, Step 800 is a step performed continuously from Step 704A of FIG. 7. In Step 800, whether the restart conditions after the automatic stop are satisfied is determined. In a case where a restart request has been issued, the determination made herein is "YES" and the flow proceeds to Step 810. In a case where a restart request has not been issued, the determination made herein is "NO" and the flow proceeds to Step 801.

In Step 801, whether a predetermined time, for example, about 60 [sec], has elapsed is determined. In a case where the predetermined time has not elapsed yet, the determination made herein is "NO" and the flow proceeds to Step 520 in which the operation is ended. In a case where the predetermined time has elapsed, the determination made herein is "YES" and the flow proceeds to Step 802. In Step 802, the push driving instruction Sc is stopped to de-energize the shift holding coil 43*b*. It should be noted that the shift attracting coil 43*a* is already de-energized by the meshing detection switch 46A. In subsequent Step 803, a memory of the issuance of the automatic stop instruction stored in Step 612*d* of FIG. 6 is cancelled. In subsequent Step 804, the cylinder sequence discrimination control is stopped and the flow proceeds to Step 520 in which the operation is ended.

In a case where the flow proceeds to Step 800 of FIG. 8 by way of FIG. 7 after the issuance of the automatic stop instruction in Step 612*d* of FIG. 6 and it is found that a following restart request is not issued as the result of the determination in Step 800, the determination made herein is "NO". Then, the flow proceeds to Step 801 in which an elapse of the predetermined time is determined. In a case where a restart request is not issued after an elapse of the predetermined time, for example 60 [sec] ("YES" determination), the driving of the shift coils 43*a* and 43*b* is stopped to return the pinion gear 42*a* in Step 802. In Step 803, a memory of the automatic stop instruction is cancelled and the cylinder sequence discrimination is stopped in Step 804. In this case, even when a restart request is issued, the engine 10 is not started. Instead, as is shown in Step 511*a* of FIG. 5, the engine 10 is started by a manual starting operation with the start instruction switch 22.

When the flow proceeds to Step 810 according to the determination ("YES" determination) in Step 800 that the restart request has been issued, a determination is made as to whether the rotation speed of the engine 10 that is decelerating by inertia because a fuel supply is stopped in Step 700*a* of FIG. 7 has reached or exceeds the predetermined rotation speed N4, for example, 400 [rpm], at or above which the engine 10 is enabled to start by itself by merely resuming the fuel supply without a driving aid of the DC electric motor 41*a*. In a case where the engine rotation speed is as high as or higher than the self-start rotation speed N4, the determination made herein is "YES" and the flow proceeds to Step 811. In a case where the engine rotation speed is lower than the self-start rotation speed N4, the determination made herein is "NO" and the flow proceeds to Step 813.

When the flow proceeds to Step 811 from Step 810, the preliminary rotational driving of the pinion gear 42*a* is stopped while the cylinder sequence discrimination control is continued. Also, the push driving is stopped to allow the pinion gear 42*a* to return to the original position. Further, a memory of the automatic stop instruction stored in Step 612*d* of FIG. 6 is cancelled. In subsequent Step 812, synchronous injection is performed sequentially to the discriminated cylinders. The flow then proceeds to Step 520 in which the operation is ended.

When the flow proceeds to Step 813 from Step 810, the rotational driving instruction Rc is given to the rotational driving control circuit 50A to start the DC electric motor 41*a* by the current-limit starting (Power-ON 1) and subsequently by the full voltage starting after a predetermined current-limit starting time ΔT (Power-ON 2). In subsequent Step 814, synchronous injection is performed sequentially to the discriminated cylinders. The flow then proceeds to Step 815. In Step 815, a determination is made as to whether the engine 10 has reached a predetermined rotation speed at or above which the engine 10 is enabled to rotate by itself. In a case where the engine 10 has not reached the predetermined rotation speed, the determination made herein is "NO" and the flow returns to Step 813. In a case where the engine 10 has reached the predetermined rotation speed, the determination made herein is "YES" and the flow proceeds to Step 816.

In Step 816, the shift attracting coil 43*a* and the shift holding coil 43*b* kept biased since Step 703A of FIG. 7 are de-energized and the flow proceeds to Step 817. In Step 817, the automatic stop instruction stored in Step 612*d* of FIG. 6 is removed and the flow proceeds to Step 818. From Step 818, the flow proceeds to Step 520 in which the operation is ended while synchronous injection for the multi-cylinder engine 10 is continued. In Step 520, after other control operations are performed and within a predetermined time, for example, 10 [msec], the flow proceeds again to Step 510 in which the operation is started.

Referring to FIG. 7 and FIG. 8, Step 701*a* is a step representing a control program constituting an engine rotation speed detection unit. Likewise, Step 702*a* is a step representing a control program constituting a first rotation speed determination unit, Step 702*b* constituting a second rotation speed determination unit, Step 704A constituting a voltage correction unit, Step 710A constituting a pinion gear push driving control unit, Step 711*a* constituting a circumferential speed deviation computation unit, Step 712*a* constituting a first circumferential speed deviation determination unit, Step 712*b* constituting a second circumferential speed deviation determination unit, Step 802 constituting an automatic stop state releasing unit, Steps 812 and 814 constituting a fuel injection control unit, and Step Block 819 made up of Step 811 and Step 812 constituting a self-restarting unit.

(3) Gist and Characteristics of the First Embodiment

The gist and the characteristics of the in-vehicle engine start control apparatus according to the first embodiment of the invention will now be described.

1) The in-vehicle engine start control apparatus according to the first embodiment of the invention is an in-vehicle engine start control apparatus 30A including:

a starting electric motor unit 40A having a DC electric motor 41*a* driven with power fed from an in-vehicle battery 20, a pinion gear 42*a* rotationally driven by the DC electric motor 41*a*, and a pinion push mechanism 44A allowing the pinion gear 42*a* to couple to and decouple from a ring gear 11 provided to a rotation shaft of an in-vehicle engine 10; a rotational driving control circuit 50A that feeds power to the DC electric motor 41*a*; and an engine control apparatus 31A that stops the engine 10 by stopping a fuel injection instruction INJ to a fuel injection electromagnetic valve 12 when an automatic stop condition is satisfied while the engine 10 is in an idle-rotation state, and restarts the engine 10 by issuing a rotational driving instruction Rc to the rotational driving control circuit 50A and the fuel injection instruction INJ when a restart condition of the engine 10 is satisfied.

The engine control apparatus 31A includes a microprocessor 32 that operates together with a program memory 33A storing a control program constituting a fuel injection control unit 517, 812, or 814.

The program memory 33A further stores a control program constituting an engine rotation speed detection unit 701*a* that operates correspondingly to a rotation sensor 13, a control program constituting a pinion rotation speed detection unit 615 that operates correspondingly to a rotation speed estimation unit 616A of the pinion gear 42*a* or a pinion rotation sensor 48, a control program constituting a preliminary rotational driving control unit 618A of the pinion gear 42*a*, and a control program constituting a push driving control unit 710A that issues a push driving instruction Sc to the pinion push mechanism 44A.

The microprocessor 32 stops the fuel injection instruction INJ when the automatic stop condition of the engine 10 is satisfied, and restarts the in-vehicle engine 10 in a inertial rotation state or a stopped state by starting rotational driving of the pinion gear 42*a* using the preliminary rotational driving control unit 618A in a vicinity of a time when fuel injection is stopped, before the engine rotation speed drops at least to a predetermined initial rotation speed even when the restart condition of the engine 10 is not satisfied so as to drive the pinion gear 42*a* to couple to the ring gear 11 using the push driving control unit 710A of the pinion gear 42*a* before the rotation speed of the engine 10 drops to a predetermined lower limit rotation speed at or above which an unstable rotation of the engine 10 does not occur, and by issuing the rotational driving instruction Rc and the fuel injection instruction INJ in a case where the restart condition of the engine 10 is already satisfied or the restart condition is satisfied with a delay when coupling driving of the pinion gear 42*a* is completed.

2) Also, the in-vehicle engine start control apparatus according to the first embodiment of the invention is configured in such a manner that:

the fuel injection control unit 517, 812, or 814 includes a cylinder sequence discrimination unit to perform sequential fuel injection to a multi-cylinder engine;

the cylinder sequence discrimination unit continues to operate while the fuel injection is stopped; and the lower limit rotation speed is an engine rotation speed as high as or higher than a fuel injection start rotation speed N0 at or above which the fuel injection is enabled by the cylinder sequence discrimination unit when the engine 10 is normally started by a start instruction switch 22.

When configured in this manner, the lower limit rotation speed of the in-vehicle engine when the push driving of the pinion gear is completed becomes a rotation speed as high as or higher than the fuel injection start rotation speed.

Hence, there can be achieved an advantage that in a case where a restart request to the engine is issued immediately after the push driving of the pinion gear is completed, fuel injection is enabled immediately and it becomes possible to start the engine quickly with an aid of rotational driving torque from the starting electric motor unit.

3) The in-vehicle engine start control apparatus according to the first embodiment of the invention is configured in such a manner that:

the program memory 33A further stores a control program constituting a self-restarting unit 819; and the self-restarting unit 819 continues cylinder sequence discrimination control even after the fuel injection instruction INJ is stopped because the automatic stop condition is satisfied, and in a case where the restart condition is satisfied before the engine rotation speed drops to or below a predetermined self-starting rotation speed, restarts the engine 10 without depending on the starting electric motor unit 40A by resuming issuance of the fuel injection instruction INJ by the fuel injection control unit 812 according to the cylinder sequence already discriminated after removing the push driving of the pinion gear 42*a* or confirming that the engine 10 is in a no-driven state.

When configured in this manner, even when the fuel injection is stopped because the automatic stop condition is satisfied, the cylinder sequence discrimination control for the engine that is decelerating by inertia is continued, and when a restart request is issued when the engine rotation speed is as high as or higher than the predetermined self-starting rotation speed, the fuel injection is resumed. The engine therefore restarts without rotationally driving the starting electric motor unit.

Hence, because there is no need to discriminate the cylinder sequence from the start when the fuel injection is resumed, it becomes possible to enable the engine to start by itself in a reliable manner by performing the fuel injection quickly to appropriate cylinders of the multi-cylinder engine.

4) The in-vehicle engine start control apparatus according to the first embodiment of the invention is configured in such a manner that:

an initial rotation speed of the engine 10 at which to start preliminary rotational driving of the pinion gear 42*a* is a rotation speed as high as or higher than the predetermined self-starting rotation speed; and the preliminary rotational driving control unit 618A stops the preliminary rotational driving instruction to the pinion gear 42*a* when a fuel supply is resumed by the self-starting unit 819.

When configured in this manner, the initial rotation speed of the engine at which to start the preliminary rotational driving of the pinion gear becomes a high rotation speed as high as or higher than the self-starting rotation speed. Hence, when the engine starts by itself according to a restart request issued early, the preliminary rotational driving of the pinion gear is stopped.

Hence, the first embodiment is characterized in that by starting the preliminary rotational driving early by setting the initial rotation speed to a rotation speed as high as possible, it becomes possible to complete the preliminary rotational driving in a reliable manner before the engine rotation speed drops.

In a case where the engine restarts by itself according to a restart request issued early on rear occasions, the preliminary rotational driving of the pinion gear becomes a wasteful operation. However, it is configured in such a manner that at least the preliminary rotational driving instruction is stopped immediately.

5) The in-vehicle engine start control apparatus according to the first embodiment is configured in such a manner that:

the preliminary rotational driving control unit 618A includes a preliminary rotational driving instruction unit 613A for the pinion gear 42*a;* the preliminary rotational driving instruction unit 613A issues a rotational driving instruction Rc as a preliminary rotational driving instruction to the rotational driving control circuit 50A when the automatic stop condition of the engine 10 is satisfied and rotationally drives the DC electric motor 41*a* via an output contact 51*a* in a current-limit starting relay and a current-limit starting resistor 51*c* provided to the rotational driving control circuit 50A;

the rotational speed estimation unit 616A estimates, according to a standard characteristic obtained by measuring a relative relation between a power feeding time and a rotation speed of the DC electric motor 41*a* using a power supply voltage as a parameter, a current rotation speed on the basis of a current power feeding time and a value of the power supply voltage; and the preliminary rotational driving control unit 618A stops the rotational driving instruction Rc when the rotation speed of the pinion gear 42*a* has reached or is predicted to reach a predetermined target rotation speed.

When configured in this manner, the preliminary rotational driving of the pinion gear is performed by feeding power to the DC electric motor via the output contact in the current-limit starting relay that operates correspondingly to the rotational driving instruction and the current-limit starting resistor.

Hence, the first embodiment is characterized in that because no excessive current flows into the DC electric motor, it becomes possible to prevent the in-vehicle battery from over-discharging, and that a difference from the target rotation speed caused by a variance of the power-feed driving time can be lessened by suppressing an abrupt increase of the rotation speed of the DC electric motor in a no load state.

6) The in-vehicle engine start control apparatus according to the first embodiment of the invention is configured in such a manner that:

the preliminary rotational driving control unit 618A includes a preliminary rotational driving instruction unit 613A for the pinion gear 42*a;* the rotational driving control circuit 50A is provided with a preliminary driving control circuit 59 annexed thereto and having an opening and closing element 56 and at least one of a low-voltage power supply circuit 55 and a current-limiting driving resistor 57;

the preliminary rotational driving instruction unit 613A issues a preliminary rotational driving instruction Tc to the opening and closing element 56 when the automatic stop condition of the engine 10 is satisfied and rotationally drives the DC electric motor 41*a* via the opening and closing element 56 and at least one of the low-voltage power supply circuit 55 and the current-limiting driving resistor 57;

the rotational speed estimation unit 616A estimates, according to a standard characteristic obtained by measuring a relative relation between a power feeding time and a rotation speed of the DC electric motor 41*a* using a power supply voltage as a parameter, a current rotation speed on the basis of a current power feeding time and a value of the power supply voltage; and the preliminary rotational driving control unit 618A stops the preliminary rotational driving instruction Tc as the rotation speed of the pinion gear 42*a* has reached a predetermined target rotation speed.

When configured in this manner, the rotational driving control circuit is provided with the preliminary driving control circuit annexed thereto and the preliminary rotational driving of the pinion gear is performed by feeding power to the DC electric motor via the opening and closing element that operates correspondingly to the preliminary rotational driving instruction.

Hence, the first embodiment is characterized in that because a large current necessary to start the engine is not flown to the opening and closing element, an opening and closing element having a large current capacity is not required, and that the target rotation speed can be obtained precisely by quickly stopping the driving of the DC electric motor when the engine reaches the target rotation speed.

7) The in-vehicle engine start control apparatus according to the first embodiment of the invention is configured in such a manner that:

the starting electric motor unit 40A is provided with a rotation sensor 48 that detects the rotation speed of the pinion gear 42*a;* the preliminary rotational driving control unit 618A includes a pinion rotation speed detection unit 615 that operates correspondingly to the rotation sensor 48 and a preliminary rotational driving instruction unit 613A;

the preliminary rotational driving instruction unit 613A rotationally drives the DC electric motor 41*a* by issuing a rotational driving instruction Rc as a preliminary rotational driving instruction to the rotational driving control circuit 50A or rotationally drives the DC electric motor 41*a* by issuing a preliminary rotational driving instruction Tc to an opening and closing element 56 connected to the DC electric motor 41*a* in series when the automatic stop condition of the engine 10 is satisfied; and in a case where the rotation speed of the pinion gear 42*a* detected by the pinion rotation speed detection unit 615 has reached the predetermined target rotation speed or where the detected rotation speed of the pinion gear 42*a* is predicted to reach the predetermined target rotation, the preliminary rotational driving control unit 618A stops the preliminary rotational driving of the pinion gear 42*a* or applies rotation speed control to the starting electric motor unit so as to maintain the rotation speed of the pinion gear 42*a* at the target rotation speed.

When configured in this manner, the starting electric motor unit is provided with the rotation sensor to measure the rotation speed of the pinion gear.

Hence, the first embodiment is characterized in that it becomes possible to approximate the rotation speed by the preliminary rotational driving precisely to the target rotation speed.

8) The in-vehicle engine start control apparatus according to the first embodiment is configured in such a manner that:

the push driving control unit 710A of the pinion gear 42*a* includes a first rotation speed determination unit 702*a* and a second rotation speed determination unit 702*b*; the push driving control unit 710A of the pinion gear 42*a* starts a pushing operation of the pinion gear 42*a* when an inertial deceleration speed of the engine 10 detected by the engine rotation speed detection unit 701*a* drops to a predetermined rotation speed;

the predetermined rotation speed is a rotation speed calculated with an aim of being a rotation speed at which a rotation circumferential speed of the ring gear 11 decelerating by inertia coincides with a rotation circumferential speed of the pinion gear 42*a* rotationally driven preliminarily when the pinion gear 42*a* and the ring gear 11 start coming into contact with each other after a required response time;

the first rotation speed determination unit 702*a* adopts a first threshold rotation speed as the predetermined rotation speed when a transmission 14 driven by the engine 10 is selected in a vehicle driving range; and the second rotation speed determination unit 702*b* adopts a second threshold rotation speed that takes a smaller value than the first threshold rotation speed as the predetermined rotation speed when the transmission 14 driven by the engine 10 is selected in a vehicle non-driving range.

When configured in this manner, it becomes possible to correct the engine rotation speed when the push driving of the pinion gear is started by paying attention to the fact that a degree of inertial decrease of the engine rotation speed varies depending on the selected range of the transmission.

Hence, the first embodiment is characterized in that it becomes possible to extend the wear life of the gears by bringing the circumferential speed of the pinion gear into coincidence with that of the ring gear when the both come into contact with each other.

9) The in-vehicle engine start control apparatus according to the first embodiment of the invention is configured in such a manner that:

the starting electric motor unit 40A is provided with a rotation sensor 48 that detects the rotation speed of the pinion gear 42*a;* the push driving control unit 710A of the pinion gear includes a circumferential speed deviation computation unit 711*a*, a first circumferential speed deviation determination unit 712*a*, and a second circumferential speed deviation determination unit 712*b;* the circumferential speed deviation computation unit 711*a* calculates a circumferential speed deviation between a circumferential speed of the ring gear 11 based on the engine rotation speed detected by the engine rotation speed detection unit 701*a* and a circumferential speed of the pinion gear 42*a* based on the rotation speed detected correspondingly to the rotation sensor 48 of the pinion gear 42*a;* the push driving control unit 710A of the pinion gear 42*a* starts a push operation of the pinion gear 42*a* when the circumferential speed deviation between the pinion gear 42*a* and the ring gear 11 calculated by the circumferential speed deviation computation unit 711*a* drops to a predetermined circumferential speed deviation;

the predetermined circumference speed deviation is a circumferential speed deviation calculated with an aim of being a circumferential speed deviation at which a rotation circumferential speed of the ring gear 11 decelerating by inertia coincides with a rotation circumferential speed of the pinion gear 42*a* rotationally driven preliminarily when the pinion gear 42*a* and the ring gear 11 start coming into contact with each other after a required response time; the first circumferential speed deviation determination unit 712*a* adopts a first threshold deviation speed as the predetermined circumferential speed deviation when a transmission 14 driven by engine 10 is selected in a vehicle driving range; and the second circumferential speed deviation determination unit 712*b* adopts a second threshold deviation speed that takes a smaller value than the first threshold deviation speed as the predetermined circumferential speed deviation when the transmission 14 driven by engine 10 is selected in a vehicle non-driving range.

When configured in this manner, it becomes possible to correct a circumferential speed deviation between the rotation circumferential speed of the ring gear and a rotation circumferential speed of the pinion gear when the push driving of the pinion gear is started by paying attention to the fact that a degree of inertial decrease of the engine rotation speed varies with a selected range of the transmission.

Hence, the first embodiment is characterized in that it becomes possible to extend the wear life of the gears by bringing the circumferential speed of the pinion gear into coincidence with that of the ring gear when the both come into contact with each other.

10) The in-vehicle engine start control apparatus according to the first embodiment is configured in such a manner that:

the pinion push mechanism 44A includes a shift attracting coil 43*a* that drives the pinion gear 42*a* to be pushed, a shift holding coil 43*b* that maintains the pinion gear 42*a* in a pushed state after pushing of the pinion gear 42*a* is completed, and a meshing detection switch 46A that cuts off power feeding to the shift attracting coil 43*a* upon detection of a completed state of the pushing; and the push driving control unit 710A of the pinion gear 42*a* includes a voltage correction unit 704A that makes an apply voltage to the shift attracting coil 43*a* and the shift holding coil 43*b* constant by issuing a push driving instruction Sc to the shift attracting coil 43*a* and the shift holding coil 43*b* and applying duty control to the push driving instruction Sc correspondingly to a power supply voltage.

When configured in this manner, a shift coil used to push the pinion gear includes the attraction coil and the holding coil. The attracting coil is de-energized after attraction is completed while an apply voltage to the respective coils is maintained at a constant level.

Hence, the first embodiment is characterized in that: it becomes possible to prevent the in-vehicle battery from overdischarging even when a meshing holding state is maintained while the engine is in a stopped state: it becomes possible to enhance synchronous meshing accuracy between the pinion gear and the ring gear because a time required for the push driving does not vary with the power supply voltage; and it becomes possible to suppress a contacting sound between the pinion gear and the ring gear occurring when the power supply voltage of the in-vehicle battery is high.

11) The in-vehicle engine start control apparatus according to the first embodiment is configured in such a manner that:

the program memory 33A further stores a control program constituting an automatic stop state releasing unit 802;

the automatic stop state releasing unit 802 releases push driving of the pinion gear 42*a* in a case where the engine 10 stops according to an occurrence of the automatic stop condition of the engine 10 and the pinion gear 42*a* is held in a pushed state for a predetermined time or longer; and the engine 10 is restarted by a manual operation using a start instruction switch 22.

When configured in this manner, in a case where there is an abnormally long delay until the occurrence of the restart condition of the engine that stopped automatically because the automatic stop condition was satisfied, the pinion gear held in a pushed state is released and the engine is inhibited from restarting by itself.

Hence, the first embodiment is characterized in that not only is it possible to prevent the in-vehicle battery from over-discharging to hold the pinion gear in a pushed state while the engine is in a stopped state, but it is also possible to prevent the engine from starting by itself accidentally after the vehicle has stopped for a long time.

12) The in-vehicle engine start control apparatus according to the first embodiment of the invention is configured in such a manner that:

the rotational driving control circuit 50A includes an output contact 51*a* in a current-limit starting relay, an output contact 52*a* in a full voltage starting relay of a normally-opened contact type, a current-limiting resistor 51*c* connected in series to the output contact 51*a* in the current-limit starting relay and connected in parallel to the output contact 52*a* in the full voltage starting relay, and a current-limit starting timer 52*c;* the current-limit starting timer 52*c* makes the output contact 52*a* close by allowing a relay coil 52*b* in the full voltage starting relay of the normally-opened contact type to be biased after a predetermined delay time since a relay coil 51*b* in the current-limit starting relay is biased according to the rotational driving instruction Rc; and the delay time of the current-limit starting timer 52*c* is set to a time longer than a preliminary rotational driving time in the preliminary rotational driving control unit 618A of the pinion gear 42*a*.

When configured in this manner, the starting electric motor unit is driven with step-wise power feeding using the current-limit starting relay, the full voltage starting relay, the current-limit starting resistor, and the current-limit starting timer, and the current-limit starting time is set longer than a time required for the preliminary rotational driving of the pinion gear.

Hence, the first embodiment is characterized in that even when the engine is started and stopped frequently according to automatic stop and restart requests, it becomes possible to extend the wear life of the relay contact damaged by a start rush current by suppressing an over-discharging of the in-vehicle battery, and that it becomes possible to complete the preliminary rotational driving with the use of the current-limit starting resistor in a case where the preliminary rotational driving of the pinion gear is performed using the starting electric motor unit.

13) The in-vehicle engine start control apparatus according to the first embodiment of the invention is configured in such a manner that:

the automatic stop condition of the engine 10 includes a condition that a power supply voltage Vb of the in-vehicle battery 20 is equal to or above a predetermined value;

the engine control apparatus 31A further includes a manual starting preference control circuit 36;

the microprocessor 32 issues a manual start inhibiting instruction INH while the microprocessor 32 is operating normally; and the manual starting preference control circuit 36 issues a rotational driving instruction Rc and a push driving instruction Sc using a start instruction switch 22 instead of a rotational driving instruction Rc and a push driving instruction Sc issued by the microprocessor 32 in a case where a charging voltage of the in-vehicle battery 20 is low and the power supply voltage Vb drops temporarily to an abnormal level because of a starting current of the starting electric motor unit 40A and the microprocessor 32 becomes unable to operate, and disables the manual starting preference control circuit 36 by the manual start inhibiting instruction INH when the microprocessor 32 resumes an operation as the power supply voltage Vb has restored while the starting current decreases with an increase of the engine rotation speed.

When configured in this manner, an automatic stop of the engine is not performed when the power supply voltage of the in-vehicle engine is low, so that even when the microprocessor becomes unable to operate because the power supply voltage of the in-vehicle battery drops to an abnormal level due to a starting current of the starting electric motor unit, a manual starting operation by the starting instruction engine is enabled.

Hence the first embodiment is characterized in that not only can an accidental starting operation by the start instruction switch be inhibited while the microprocessor is operating normally, but also restart control of the engine can be performed readily using the control function of the microprocessor.

Second Embodiment

(1) Detailed Description of the Configuration

An in-vehicle engine start control apparatus according to a second embodiment of the invention will now be described. FIG. 9 is a view showing the overall configuration of the in-vehicle engine start control apparatus according to the second embodiment of the invention. Hereinafter, differences from the first embodiment above will mainly be described and like components are labeled with like reference numerals in respective drawings.

Figure 9:
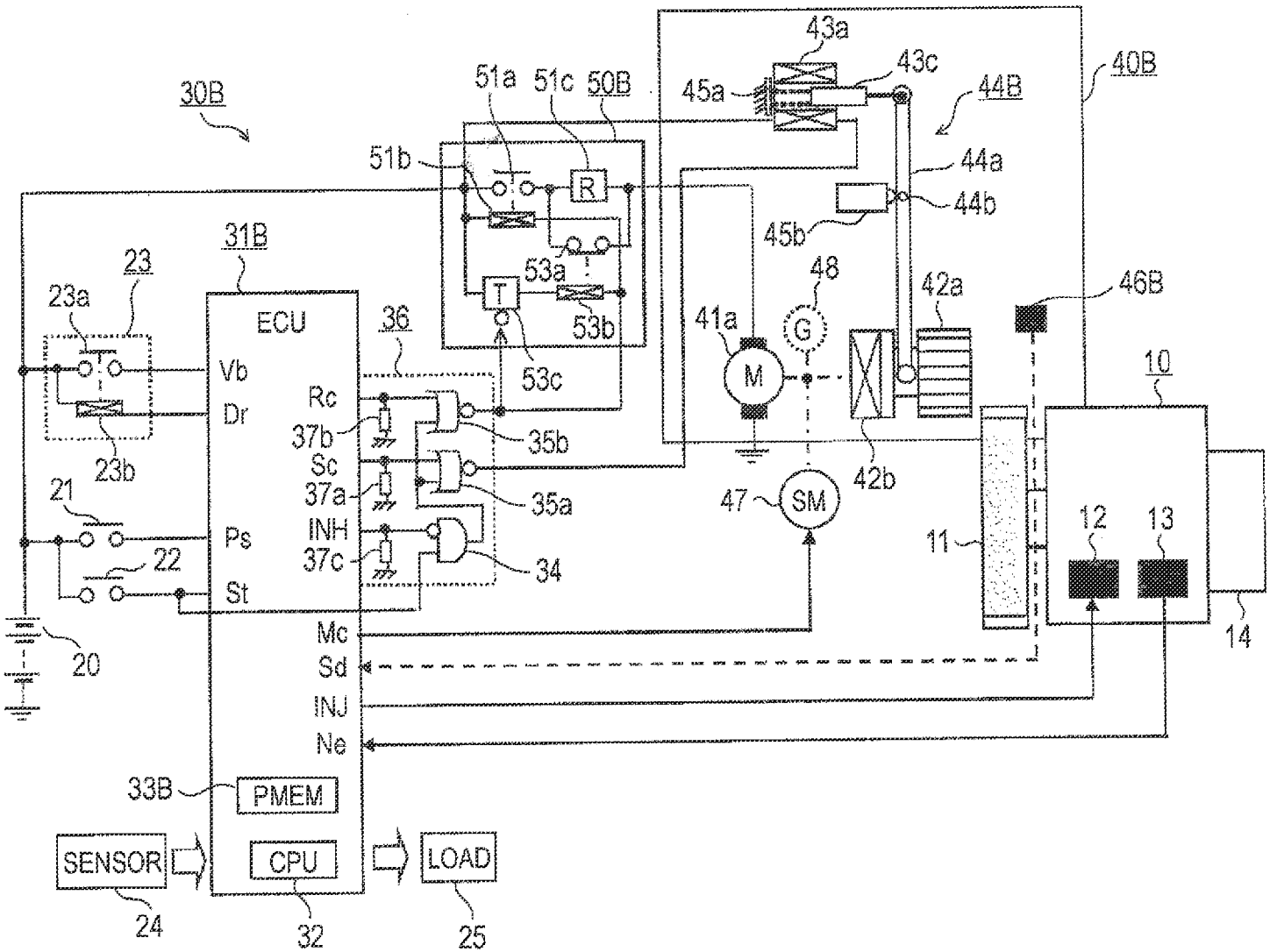
FIG. 9 is a view showing the overall configuration of an in-vehicle engine start control apparatus according to a second embodiment of the invention.

Referring to FIG. 9, an in-vehicle engine start control apparatus 30B is formed of an engine control apparatus 31B, a starting electric motor unit 40B for a multi-cylinder in-vehicle engine 10, and a rotational driving control circuit 50B for the starting electric motor unit 40B. The engine control apparatus 31B contains therein a program memory 33B that operates together with a microprocessor 32 and is configured in such a manner that a power supply switch signal Ps and a manual start instruction signal St are inputted therein, respectively, from a power supply switch 21 and a start instruction switch 22 each connected to an in-vehicle battery 20 and operating correspondingly to opening and closing operations of the corresponding switch.

As with FIG. 1, an output contact 23*a* in a power supply relay 23 forms a power feeding circuit from the in-vehicle battery 20 to the engine control apparatus 31B and supplies power, which is a power supply voltage Vb, to the engine control apparatus 31B. A relay coil 23*b* in the power supply relay 23 is biased to close the output contact 23*a* as the power supply switch 21 is closed and the microprocessor 32 starts to operate as the output contact 23*a* in the power supply relay 23 closes. Once the microprocessor 32 starts to operate, even when the power supply switch 21 is opened, a biased state of the relay coil 23*b* in the power supply relay 23 is maintained according to a power supply hold instruction Dr issued by the microprocessor 32, so that the output contact 23*a* remains closed.

A sensor group 24 for the engine control apparatus 31B includes switch sensors and analog sensors, such as a detection switch that detects depression of an accelerator pedal and a brake pedal, a shift switch that operates correspondingly to a selected position of a shift lever of a transmission 14, an accelerator position sensor that detects the degree of depression of the accelerator pedal, a throttle position sensor that detects an aperture of a throttle valve, and an exhaust gas sensor that detects an oxygen concentration in an exhaust gas. An output of a rotation sensor 13, which is a part of the sensor group 24, is inputted into the microprocessor 32 as an engine rotation signal Ne.

An electric load group 25 driven by the engine control apparatus 31B includes a throttle valve aperture control motor, a sparking coil for a gasoline engine, and a speed selection electromagnetic coil. To a fuel injection electromagnetic valve 12, which is a part of the electric load group 25, a fuel injection instruction INJ is outputted from the microprocessor 32.

The starting electric motor unit 40B is formed of a DC electric motor 41*a* as a main body, a pinion gear 42*a* rotationally driven in one direction by the DC electric motor 41*a* via a one-way clutch 42*b*, and a pinion push mechanism 44B allowing the pinion gear 42*a* to mesh with and couple to a ring gear 11.

The pinion push mechanism 44B is formed of a shift lever 44*a* that swings about a movable supporting point 44*b*, a shift plunger 43*c* that is provided at one end of the shift lever 44*a* and moves leftward by attraction when a shift attracting coil 43*a* is energized, a return spring 45*a* that drives the shift plunger 43*c* to return rightward in the drawing when the shift attracting coil 43*a* is de-energized, and an accumulation spring 45*b* that completes an attraction operation of the shift plunger 43*c* as the movable supporting point 44*b* moves leftward in the drawing when tooth planes of the pinion gear 42*a* and the ring gear 11 come into contact with each other. The other end of the shift lever 44*a* is engaged in a rotatable manner with a spool that drives the pinion gear 42*a* to be pushed rightward in the drawing.

In a case where the movable supporting point 44*b* moves leftward in the drawing as the tooth planes of the pinion gear 42*a* and the ring gear 11 come into contact with each other when the shift plunger 43*c* is attracted leftward in the drawing because the shift attracting coil 43*a* is energized, rotations of the pinion gear 42*a* cause the tooth plane of the pinion gear 42*a* to undergo displacement with respect to the ring gear 11. Then, the movable supporting point 44*b* is forced to return by the accumulation spring 45*b* and meshed-coupling between the pinion gear 42*a* and the ring gear 11 is completed.

A meshing detection switch 46B inputs a meshing detection signal Sd into the microprocessor 32 when the meshed-coupling between the pinion gear 42*a* and the ring gear 11 is completed. It is preferable to provide a rotation sensor 48 that detects a rotation speed of the pinion gear 42*a* to a rotation shaft of the DC electric motor 41*a*.

The rotational driving control circuit 50B is formed of an output contact 51*a* and a relay coil 51*b* in a current-limit starting relay of a normally-opened contact type, a current-limit starting resistor 51*c*, an output contact 53*a* and a relay coil 53*b* in a full voltage starting relay of a normally-closed contact type, and a current-limit starting timer 53*c*. The current-limit starting resistor 51*c* and the output contact 51*a* are connected in series between the in-vehicle battery 20 and the DC electric motor 41*a*. The output contact 53*a* is connected to the current-limit starting resistor 51*c* in parallel.

An output contact of the current-limit starting timer 53*c* and the relay coil 53*b* are connected in series. When the microprocessor 32 issues a rotational driving instruction Rc, the relay coil 51*b* in the current-limit starting relay and the relay coil 53*b* in the full voltage starting relay are biased first to close the output contact 51*a* in the current-limit starting relay and to open the output contact 53*a* in the full voltage starting relay, respectively. Accordingly, power is fed from the in-vehicle battery 20 to the DC electric motor 41*a* via the output contact 51*a* and the current-limit starting resistor 51*c*. Thereafter, the current-limit starting timer 53*c* counts a predetermined time and the relay coil 53*b* in the full voltage starting relay is de-energized. The current-limit starting resistor 51*c* is then short-circuited by the output contact 53*a*. Accordingly, a full voltage is supplied to the DC electric motor 41*a* from the in-vehicle battery 20 via a series circuit made up of the output contact 51*a* and the output contact 53*a*.

When the rotation speed of the DC electric motor 41*a* has reached or exceeds a predetermined rotation speed, the current-limit starting timer 53*c* stops counting immediately, so that the full voltage starting relay is de-energized. Alternatively, the current-limit starting resistor 51*c* may be connected upstream of the output contact 51*a* in the current-limit starting relay.

A manual starting preference circuit 36 contained in the engine control apparatus 31B is configured in the same manner as the counterpart of FIG. 1. Accordingly, it is possible to continue the manual starting operation when the microprocessor 32 becomes unable to operate temporarily during a starting operation.

An auxiliary electric motor 47 to rotationally drive the pinion gear 42*a* preliminarily instead of the DC electric motor 41*a* is rotationally driven upon receipt of a preliminary rotational driving instruction Mc from the microprocessor 32 and rotates at a rotation speed proportional to an average voltage of the preliminary rotational driving instruction Mc under duty control or rotates at a rotation speed proportional to a frequency of the preliminary rotational driving instruction Mc.

As has been described, the in-vehicle engine start control apparatus 30B according to the second embodiment of the invention shown in FIG. 9 uses the auxiliary electric motor 47 instead of the preliminary driving control circuit 59 of FIG. 1 described above and is therefore able to control a preliminary rotation speed of the pinion gear 42*a* precisely on small electric power.

In a case where the preliminary driving control circuit 59 or the auxiliary electric motor 47 is used, it becomes possible to prevent the pinion gear 42*a* from decelerating by inertia by controlling the pinion gear 42*a* that has reached a preliminary driving rotation speed N3 owing to the preliminary rotational driving to maintain the preliminary driving rotation speed N3 until the push control of the pinion gear 42*a* starts. A difference between the rotational driving control circuit 50A of FIG. 1 and the rotational driving control circuit 50B of FIG. 9 is that whether the output contact in the full voltage starting relay is a normally-opened contact or a normally-closed contact. It is therefore possible to use the rotational driving control circuit 50B in the apparatus of FIG. 1 and conversely to use the rotational driving control circuit 50A in the apparatus of FIG. 9.

The shift holding coil 43*b* shown in FIG. 1 is omitted from the pinion push mechanism 44B of FIG. 9 and the shift plunger 43*c* is attracted by the shift attracting coil 43*a* and held by reducing a power feeding average voltage to the shift attracting coil 43*a* upon activation of a meshing sensor 46B. It is, however, possible to use the pinion push mechanism 44B of FIG. 9 in the apparatus of FIG. 1 and conversely to use the pinion push mechanism 44A of FIG. 1 in the apparatus of FIG. 9.

(2) Detailed Description of Function and Operation

Hereinafter, an operation of the in-vehicle engine start control apparatus 30B according to the second embodiment of the invention configured as above will be described using the time charts of FIG. 2 through FIG. 4 by focusing a difference from the first embodiment above.

Referring to FIG. 9, when the power supply switch 21 is closed firstly, the microprocessor 32 in the engine control apparatus 31B starts to operate. The microprocessor 32 drives the electric load group 25 including the fuel injection electromagnetic valve 12, the pinion push mechanism 44B, and the rotational driving control circuit 50B under its control in a corresponding manner to an operation state of the sensor group 24 including the rotation sensor 13 and the content of the control program pre-written in the program memory 33B.

An operation involved with an initial start of the engine 10 and with the engine restarting in a case where the engine 10 stops automatically according to an automatic stop request issued while the engine 10 is operating and a restart request is issued after the engine 10 stops completely is indicated by the time chart of FIG. 2 described above. Referring to FIG. 2, a difference between the first embodiment of FIG. 1 and the second embodiment of FIG. 9 is the preliminary rotational driving instruction represented by (J) of FIG. 2. In the first embodiment of FIG. 1, the preliminary rotational driving instruction Tc (or the rotational driving instruction Rc) is used whereas the preliminary rotational driving instruction Mc is used in the second embodiment of FIG. 9.

Also, as has been described, because the shift holding coil is not provided in the second embodiment, an attraction holding operation of the shift plunger 43*c* is performed by reducing an applied voltage to the shift attracting coil 43*a* in a time zone from t2 to t5 where (B) of FIG. 2 is excluded from (C) of FIG. 2.

An operation involved with an initial start of the engine 10 and with the engine restarting in a case where a restart request is issued early immediately after an automatic stop request is issued while the engine 10 is operating is indicated by the time chart of FIG. 3 described above. Referring to FIG. 3, a difference between the first embodiment of FIG. 1 and the second embodiment of FIG. 9 is the preliminary rotational driving instruction represented by (J) of FIG. 3. In the first embodiment of FIG. 1, the preliminary rotational driving instruction Tc (or the rotational driving instruction Rc) is used whereas the preliminary rotational driving instruction Mc is used in the second embodiment of FIG. 9.

Also, as has been described, because the shift holding coil is not provided in the second embodiment, an attraction holding operation of the shift plunger 43*c* is performed by reducing an applied voltage to the shift attracting coil 43*a* in a time zone from t2 to t5 where (B) of FIG. 3 is excluded from (C) of FIG. 3.

An operation involved with an initial start of the engine 10 and the engine restarting in a case where a restart request is issued while the engine 10 is decelerating immediately after an automatic stop request is issued while the engine 10 is operating is indicated by the time chart of FIG. 4 described above. Referring to FIG. 4, a difference between the first embodiment of FIG. 1 and the second embodiment of FIG. 9 is the preliminary rotational driving instruction represented by (J) of FIG. 4. In the first embodiment of FIG. 1, the preliminary rotational driving instruction Tc (or the rotational driving instruction Rc) is used whereas the preliminary rotational driving instruction Mc is used in the second embodiment of FIG. 9.

Also, as has been described, because the shift holding coil is not provided in the second embodiment, an attraction holding operation of the shift plunger 43*c* is performed by reducing an applied voltage to the shift attracting coil 43*a* in a time zone from t2 to t5 where (B) of FIG. 4 is excluded from (C) of FIG. 4.

The in-vehicle engine start control apparatus 30B according to the second embodiment of the invention will now be described using the flowcharts of FIG. 5 through FIG. 8 depicting an operation of the microprocessor 32 by focusing a difference from the first embodiment above.

The first flowchart of FIG. 5 chiefly depicting the manual start control is the same as in the first embodiment above.

In the second flowchart of FIG. 6 chiefly depicting the preliminary rotational driving control on the pinion gear 42*a*, Step Block 618B including Step 613B and Step 616B is different from the case in the first embodiment above and Step 611*b* is unnecessary in the second embodiment. Step 613B is a step from which the flow proceeds to Step 614 after a preliminary rotational driving instruction is issued. The term, "preliminary rotational driving instruction", referred to herein means the preliminary rotational driving instruction Mc to the auxiliary electric motor 47.

In Step 616B, the current rotation speed of the pinion gear 42*a* is estimated on the basis of an average voltage of the preliminary rotational driving instruction Mc or a frequency of the preliminary rotational driving instruction Mc and the converted pinion rotation number in terms of the circumferential speed of the ring gear 11 is calculated through computation.

In the third flowchart of FIG. 7 chiefly depicting the push driving control on the pinion gear 42*a*, Step Block 710B containing Step 703B and Step 704B is different from the case in the first embodiment above. In Step 703B, the push driving instruction Sc is issued to bias the shift attracting coil 43*a*.

Subsequent Step 704B is a step constituting a voltage correction unit that maintains the contact required time Δt of the pinion gear 42*a* and the ring gear 11 constant by maintaining a voltage applied to the shift attracting coil 43*a* at a constant value by switching ON and OFF states of the push driving instruction Sc so that the conducting duty takes a value inversely proportional to the value of the power supply voltage Vb of the in-vehicle battery 20. In Step 704B, the conducting duty is further suppressed when either a predetermined time has elapsed since the energization of the shift attracting coil 43*a* was started or when the meshing sensor 46B activates, and the holding operation of the shift plunger 43*c* is performed by the shift attracting coil 43*a*.

The fourth flowchart of FIG. 8 chiefly depicting the engine restart control is the same as in the first embodiment above.

(3) Gist and Characteristics of the Second Embodiment

Hereinafter, the gist and the characteristics of the in-vehicle engine start control apparatus according to the second embodiment of the invention will be described.

1) The in-vehicle engine start control apparatus according to the second embodiment is an in-vehicle engine start control apparatus 30B including:

a starting electric motor unit 40B having a DC electric motor 41*a* driven with power fed from an in-vehicle battery 20, a pinion gear 42*a* rotationally driven by the DC electric motor 41*a*, and a pinion push mechanism 44B allowing the pinion gear 42*a* to couple to and decouple from a ring gear 11 provided to a rotation shaft of an in-vehicle engine 10; a rotational driving control circuit 50B that feeds power to the DC electric motor 41*a*; and an engine control apparatus 31B that stops the engine 10 by stopping a fuel injection instruction INJ to a fuel injection electromagnetic valve 12 when an automatic stop condition is satisfied while the engine 10 is in an idle-rotation state, and restarts the engine 10 by issuing a rotational driving instruction Rc to the rotational driving control circuit 50B and the fuel injection instruction INJ when a restart condition of the engine 10 is satisfied.

The engine control apparatus 31B includes a microprocessor 32 that operates together with a program memory 33B storing a control program constituting fuel injection control unit 517, 812, or 814.

The program memory 33B further stores a control program constituting an engine rotation speed detection unit 701*a* that operates correspondingly to a rotation sensor 13, a control program constituting a pinion rotation speed detection unit 615 that operates correspondingly to a rotation speed estimation unit 616B of the pinion gear 42*a* or a pinion rotation sensor 48, a control program constituting a preliminary rotational driving control unit 618B of the pinion gear 42*a*, and a control program constituting a push driving control unit 710B that issues a push driving instruction Sc to the pinion push mechanism 44B.

The microprocessor 32 stops the fuel injection instruction INJ when the automatic stop condition of the engine 10 is satisfied, and restarts the in-vehicle engine 10 in a inertial rotation state or a stopped state by starting rotational driving of the pinion gear 42*a* using the preliminary rotational driving control unit 618B in a vicinity of a time when fuel injection is stopped, before the engine rotation speed drops at least to a predetermined initial rotation speed even when the restart condition of the engine 10 is not satisfied so as to drive the pinion gear 42*a* to couple to the ring gear 11 using the push driving control unit 710B of the pinion gear 42*a* before the rotation speed of the engine 10 drops to a predetermined lower limit rotation speed at or above which an unstable rotation of the engine 10 does not occur, and by issuing the rotational driving instruction Rc and the fuel injection instruction INJ in a case where the restart condition of the engine 10 is already satisfied or the restart condition is satisfied with a delay when coupling driving of the pinion gear 42*a* is completed.

2) The in-vehicle engine start control apparatus according to the second embodiment of the invention is configured in such a manner that:

the preliminary rotational driving control unit 618B includes a preliminary rotational driving instruction unit 613B for the pinion gear 42*a* and issues a preliminary rotational driving instruction Mc to an auxiliary electric motor 47 connected to the DC electric motor 41*a* when the automatic stop condition of the engine 10 is satisfied;

the auxiliary electric motor 47 rotates at a rotation speed proportional to an instruction voltage of the preliminary rotational driving instruction Mc or a rotation speed proportional to a pulse frequency of the preliminary rotational driving instruction Mc;

the rotation speed estimation unit 616B estimates the rotation speed on the basis of the instruction voltage or the pulse frequency of the preliminary rotational driving instruction Mc; and when the rotation speed of the pinion gear 42*a* has reached a predetermined target rotation speed, the preliminary rotational driving control unit 618B stops the preliminary rotational driving instruction Mc or performs rotation speed control so as to maintain the target rotation speed.

When configured in this manner, the small auxiliary electric motor is connected to the large DC electric motor used to start the engine and the preliminary rotational driving of the pinion gear is performed by the auxiliary electric motor.

Hence, the second embodiment is characterized in that: because the large DC electric motor used to start the engine is not used to rotationally drive the pinion gear under a no load, efficiency of the driving control can be enhanced; it becomes possible to prevent the in-vehicle battery from over-discharging; and the target rotation speed can be obtained in a stable manner because the rotation speed can be controlled with ease.

3) The in-vehicle engine start control apparatus according to the second embodiment of the invention is configured in such a manner that:

the starting electric motor unit 40B is provided with a rotation sensor 48 that detects the rotation speed of the pinion gear 42*a;* the preliminary rotational driving control unit 618B includes a pinion rotation speed detection unit 615 that operates correspondingly to the rotation sensor 48 and a preliminary rotational driving instruction unit 613B;

the preliminary rotational driving instruction unit 613B issues a preliminarily rotational driving instruction Mc to an auxiliary electric motor 47 connected to the DC electric motor 41*a* when the automatic stop condition of the engine 10 is satisfied; and in a case where the rotation speed of the pinion gear 42*a* detected by the pinion rotation speed detection unit 615 has reached or is predicted to reach the predetermined target rotation speed, the preliminary rotational driving control unit 618B stops the preliminary rotational driving of the pinion gear 42*a* or applies rotation speed control to the starting electric motor unit 40B so as to maintain the target rotation speed.

When configured in this manner, the starting electric motor unit is provided with the rotation sensor to measure the rotation speed of the pinion gear and the auxiliary electric motor to perform the preliminary rotational driving. Hence, the second embodiment is characterized in that it becomes possible to approximate the rotation speed of the preliminary rotational driving precisely to the target rotation speed.

4) The in-vehicle engine start control apparatus according to the second embodiment is configured in such a manner that:

the pinion push mechanism 44B includes a shift attracting coil 43*a* that drives the pinion gear 42*a* to be pushed; and the push driving control unit 710B of the pinion gear 42*a* includes a power voltage correction unit 704B that makes an apply voltage to the shift attracting coil 43*a* to be a constant attraction driving voltage by issuing a push driving instruction Sc to the shift attracting coil 43*a* and applying duty control to the push driving instruction Sc correspondingly to a power supply voltage, and lowers the apply voltage to a hold-driving voltage after a predetermined time or in a corresponding manner to an operation of a meshing sensor 46B.

When configured in this manner, the constant attraction driving voltage is applied to the shift attracting coil used to push the pinion gear and the hold-driving voltage is applied thereto after the attraction is completed.

Hence, the second embodiment is characterized in that: it becomes possible to prevent the in-vehicle battery from over-discharging even when a meshing holding state is maintained while the engine is in a stopped state: it becomes possible to enhance synchronous meshing accuracy between the pinion gear and the ring gear because a time required for the push driving does not vary with the power supply voltage; and it becomes possible to suppress a contacting sound between the pinion gear and the ring gear occurring when the power supply voltage of the in-vehicle battery is high.

5) The in-vehicle engine start control apparatus according to the second embodiment of the invention is configured in such a manner that:

the rotational driving control circuit 50B includes an output contact 51*a* in a current-limit starting relay, an output contact 53*a* in a full voltage starting relay of a normally-closed contact type, a current-limiting resistor 51*c* connected in series to the output contact 51*a* in the current-limit starting relay and connected in parallel to the output contact 53*a* in the full voltage starting relay, and a current-limit starting timer 53*c;* the current-limit starting timer 53*c* makes the output contact 53*a* open by allowing a relay coil 53*b* in the full voltage starting relay of the normally-closed contact type to be biased simultaneously with a relay coil 51*b* in the current-limit starting relay according to the rotational driving instruction Rc to allow the output contact 53*a* return and close by de-energizing the relay coil 53*b* in the full voltage starting relay after a predetermined delay time; and the delay time of the current-limit starting timer 53*c* is set to a time longer than a preliminary rotational driving time in the preliminary rotational driving control unit 618B of the pinion gear 42*a*.

When configured in this manner, the starting electric motor unit is driven with step-wise power feeding using the current-limit starting relay, the full voltage starting relay, the current-limit starting resistor, and the current-limit starting timer, and the current-limit starting time is set longer than a time required for the preliminary rotational driving of the pinion gear.

Hence, the second embodiment is characterized in that even when the engine is started and stopped frequently according to automatic stop and restart requests, it becomes possible to extend the wear life of the relay contact damaged by a start rush current by suppressing an over-discharging of the in-vehicle battery.

Various modifications and alterations of this invention will be apparent to those skilled in the art without departing from the scope and spirit of this invention, and it should be understood that this is not limited to the illustrative embodiments set forth herein.

What is claimed is:

1. An in-vehicle engine start control apparatus, comprising:

a starting electric motor unit having a DC electric motor driven with power fed from an in-vehicle battery, a pinion gear rotationally driven by the DC electric motor, and a pinion push mechanism allowing the pinion gear to couple to and decouple from a ring gear provided to a rotation shaft of an in-vehicle engine;

a rotational driving control circuit that controls driving of the DC electric motor; and an engine control apparatus that stops the in-vehicle engine by stopping a fuel injection instruction to a fuel injection electromagnetic valve when an automatic stop condition is satisfied while the in-vehicle engine is in an idle-rotation state, and restarts the in-vehicle engine by issuing a rotational driving instruction to the rotational driving control circuit and the fuel injection instruction to the fuel injection electromagnetic valve when a restart condition of the in-vehicle engine is satisfied, wherein:

the engine control apparatus includes a microprocessor that operates together with a program memory storing a control program constituting a fuel injection control unit, the fuel injection control unit includes a cylinder sequence discrimination unit that is configured to continue to operate while the fuel injection is stopped and discriminates cylinders to perform sequential fuel injection on a plurality of cylinders of the in-vehicle engine; and the program memory further stores a control program constituting an engine rotation speed detection unit that operates correspondingly to an output of a rotation sensor detecting a rotation speed of the in-vehicle engine, a control program constituting a pinion rotation speed detection unit that operates correspondingly to a rotation sensor that detects the rotation speed of the pinion gear, or a rotation speed estimation unit that estimates a rotation speed of the pinion gear, and a control program constituting a preliminary rotational driving control unit that rotationally drives the pinion gear preliminarily, a control program constituting a push driving control unit that issues a push driving instruction to the pinion push mechanism and a control program constituting a self-restarting unit; and the microprocessor stops the fuel injection instruction when the automatic stop condition of the in-vehicle engine is satisfied, and restarts the in-vehicle engine in one of a inertial rotation state and a stopped state by starting preliminary rotational driving of the pinion gear using the preliminary rotational driving control unit in a vicinity of a time when fuel injection is stopped, before the rotation speed of the in-vehicle engine drops at least to a predetermined initial rotation speed even when the restart condition of the in-vehicle engine is not satisfied so as to drive the pinion gear to couple to the ring gear using the push driving control unit before the rotation speed of the in-vehicle engine drops to a predetermined lower limit rotation speed that is an engine rotation speed as high as or higher than a fuel injection start rotation speed at or above which the fuel injection is enabled according to a cylinder sequence discriminated by the cylinder sequence discrimination unit when the in-vehicle engine is normally started by a start instruction switch, and by issuing the rotational driving instruction and the fuel injection instruction under one of circumstances where the restart condition of the in-vehicle engine is already satisfied and where the restart condition is satisfied with a delay when coupling driving of the pinion gear is completed, and the self-restarting unit continues cylinder sequence discrimination control to discriminate a cylinder sequence to perform sequential fuel injection on a plurality of cylinders of the in-vehicle engine even after the fuel injection instruction is stopped because the automatic stop condition is satisfied, and in a case where the restart condition is satisfied before the rotation speed of the in-vehicle engine drops to or below a predetermined self-starting rotation speed, restarts the in-vehicle engine without depending on the starting electric motor unit by resuming issuance of the fuel injection instruction by the fuel injection control unit according to the cylinder sequence already discriminated after performing one of an operation to remove the push driving instruction to the pinion push mechanism, or an operation to confirm that the pinion push mechanism is in a no-driven state, wherein:

an initial rotation speed of the in-vehicle engine at which to start preliminary rotational driving of the pinion gear is a rotation speed as high as or higher than the predetermined self-starting rotation speed; and the preliminary rotational driving control unit stops an instruction of the preliminary rotational driving of the pinion gear when a fuel supply is resumed by the self-starting unit, wherein:

an initial rotation speed of the in-vehicle engine at which to start preliminary rotational driving of the pinion gear is a rotation speed as high as or higher than the predetermined self-starting rotation speed; and the preliminary rotational driving control unit stops an ins of the preliminary rotational driving of the pinion gear when a fuel supply is resumed by the self-starting unit.

2. The in-vehicle engine start control apparatus according to claim 1, wherein:

the preliminary rotational driving control unit includes a preliminary rotational driving instruction unit for the pinion gear;

the preliminary rotational driving instruction unit issues a rotational driving instruction as a preliminary rotational driving instruction to the rotational driving control circuit when the automatic stop condition of the in-vehicle engine is satisfied and rotationally drives the DC electric motor via an output contact in a current-limit starting relay and a current-limit starting resistor provided to the rotational driving control circuit;

the rotational speed estimation unit estimates, according to a standard characteristic obtained by measuring a relative relation between a power feeding time and a rotation speed of the DC electric motor using a power supply voltage of the in-vehicle battery as a parameter, a current rotation speed of the pinion gear on the basis of a current power feeding time and a value of the power supply voltage; and the preliminary rotational driving control unit stops the rotational driving instruction under one of circumstances where the rotation speed of the pinion gear estimated has reached a predetermined target rotation speed and where the rotation speed of the pinion gear estimated is predicted to reach the predetermined target rotation speed.

3. The in-vehicle engine start control apparatus according to claim 1, wherein:

the preliminary rotational driving control unit includes a preliminary rotational driving instruction unit that issues a preliminary rotational driving instruction to the pinion gear;

the rotational driving control circuit is provided with a preliminary driving control circuit annexed thereto and having an opening and closing element and at least one of a low-voltage power supply circuit and a current-limiting driving resistor;

the preliminary rotational driving instruction unit issues the preliminary rotational driving instruction to the opening and closing element when the automatic stop condition of the in-vehicle engine is satisfied and rotationally drives the DC electric motor via the opening and closing element and at least one of the low-voltage power supply circuit and the current-limiting driving resistor;

the rotational speed estimation unit estimates, according to a standard characteristic obtained by measuring a relative relation between a power feeding time and a rotation speed of the DC electric motor using a power supply voltage as a parameter, a current rotation speed of the pinion gear on the basis of a current power feeding time and a value of the power supply voltage; and the preliminary rotational driving control unit stops the preliminary rotational driving instruction as the rotation speed of the pinion gear estimated has reached a predetermined target rotation speed.

4. The in-vehicle engine start control apparatus according to claim 1, further comprising:

an auxiliary electric motor connected to the DC electric motor, wherein:

the preliminary rotational driving control unit includes a preliminary rotational driving instruction unit for the pinion gear;

the preliminary rotational driving instruction unit issues a preliminary rotational driving instruction to the auxiliary electric motor when the automatic stop condition of the in-vehicle engine is satisfied;

the auxiliary electric motor rotates at one of a rotation speed proportional to an instruction voltage of the preliminary rotational driving instruction and a rotation speed proportional to a pulse frequency of the preliminary rotational driving instruction;

the rotational speed estimation unit estimates a current rotation speed of the pinion gear on the basis of one of the instruction voltage and the pulse frequency of the preliminary rotational driving instruction; and the preliminary rotational driving control unit performs, when the rotation speed of the pinion gear estimated has reached a predetermined target rotation speed, one of an operation to stop the preliminary rotational driving instruction and an operation to apply rotation speed control on the auxiliary electric motor so as to maintain the rotation speed of the pinion gear at the target rotation speed.

5. The in-vehicle engine start control apparatus according to claim 1, wherein:

the starting electric motor unit is provided with a rotation sensor that detects the rotation speed of the pinion gear;

the preliminary rotational driving control unit includes a pinion rotation speed detection unit that operates correspondingly to an output of the rotation sensor and a preliminary rotational driving instruction unit for the pinion gear;

the preliminary rotational driving instruction unit performs, when the automatic stop condition of the in-vehicle engine is satisfied, one of an operation to rotationally drive the DC electric motor by issuing a rotational driving instruction as a preliminary rotational driving instruction to the rotational driving control circuit, an operation to rotationally drive the DC electric motor by issuing a preliminary rotational driving instruction to an opening and closing element connected to the DC electric motor in series, and an operation to issue a preliminary rotational driving instruction to an auxiliary electric power connected to the DC electric motor; and the preliminary rotational driving control unit performs, under one of circumstances where the rotation speed of the pinion gear detected by the pinion rotation speed detection unit has reached a predetermined target rotation speed and where the detected rotation speed of the pinion gear is predicted to reach the predetermined target rotation, one of an operation to stop the preliminary rotational driving of the pinion gear and an operation to apply rotation speed control to the starting electric motor unit so as to maintain the rotation speed of the pinion gear at the target rotation speed.

6. The in-vehicle engine start control apparatus according to claim 1, wherein:

the push driving control unit of the pinion gear includes a first rotation speed determination unit and a second rotation speed determination unit and starts a pushing operation of the pinion gear when the rotation speed of the in-vehicle engine decelerating by inertia detected by the engine rotation speed detection unit drops to a predetermined rotation speed;

the predetermined rotation speed is a rotation speed calculated with an aim of being a rotation speed at which a rotation circumferential speed of the ring gear decelerating by inertia coincides with a rotation circumferential speed of the pinion gear rotationally driven preliminarily by the preliminary rotational driving control unit when the pinion gear and the ring gear start coming into contact with each other after a required response time;

the first rotation speed determination unit adopts a first threshold rotation speed as the predetermined rotation speed when a transmission driven by the in-vehicle engine is selected in a vehicle driving range; and the second rotation speed determination unit adopts a second threshold rotation speed that takes a smaller value than the first threshold rotation speed as the predetermined rotation speed when the transmission driven by the in-vehicle engine is selected in a vehicle non-driving range.

7. The in-vehicle engine start control apparatus according to claim 6, wherein:

the pinion push mechanism includes a shift attracting coil that drives the pinion gear to be pushed, a shift holding coil that maintains the pinion gear in a pushed state after pushing of the pinion gear is completed, and a meshing detection switch that cuts off power feeding to the shift attracting coil upon detection of a completed state of the pushing; and the push driving control unit of the pinion gear includes a voltage correction unit that makes an apply voltage to the shift attracting coil and the shift holding coil constant by issuing a push driving instruction to the shift attracting coil and the shift holding coil and applying duty control to the push driving instruction correspondingly to a power supply voltage.

8. The in-vehicle engine start control apparatus according to claim 6, wherein:

the pinion push mechanism includes a shift attracting coil that drives the pinion gear to be pushed; and the push driving control unit of the pinion gear includes a power voltage correction unit that makes an apply voltage to the shift attracting coil to be a constant attraction driving voltage by issuing a push driving instruction to the shift attracting coil and applying duty control to the push driving instruction correspondingly to a power supply voltage and lowers the apply voltage to a hold-driving voltage in one of a manner so as to lower the apply voltage after a predetermined time and a manner so as to lower the apply voltage correspondingly to an operation of a meshing sensor.

9. The in-vehicle engine start control apparatus according to claim 1, wherein:

the starting electric motor unit is provided with a rotation sensor that detects the rotation speed of the pinion gear;

the push driving control unit of the pinion gear includes a circumferential speed deviation computation unit, a first circumferential speed deviation determination unit, and a second circumferential speed deviation determination unit;

the circumferential speed deviation computation unit calculates a circumferential speed deviation between a circumferential speed of the ring gear based on the rotation speed of the in-vehicle engine detected by the in-vehicle engine rotation speed detection unit and a circumferential speed of the pinion gear based on the rotation speed of the pinion gear detected by the rotation sensor detecting the rotation speed of the pinion gear;

the push driving control unit of the pinion gear starts a push operation of the pinion gear when the circumferential speed deviation between the pinion gear and the ring gear calculated by the circumferential speed deviation computation unit drops to a predetermined circumferential speed deviation;

the predetermined circumference speed deviation is a circumferential speed deviation calculated with an aim of being a circumferential speed deviation at which a rotation circumferential speed of the ring gear decelerating by inertia coincides with a rotation circumferential speed of the pinion gear rotationally driven preliminarily by the preliminary rotational driving control unit when the pinion gear and the ring gear start coming into contact with each other after a required response time;

the first circumferential speed deviation determination unit adopts a first threshold deviation speed as the predetermined circumferential speed deviation when a transmission driven by the in-vehicle engine is selected in a vehicle driving range; and the second circumferential speed deviation determination unit adopts a second threshold deviation speed that takes a smaller value than the first threshold deviation speed as the predetermined circumferential speed deviation when the transmission driven by the in-vehicle engine is selected in a vehicle non-driving range.

10. The in-vehicle engine start control apparatus according to claim 9, wherein:

the pinion push mechanism includes a shift attracting coil that drives the pinion gear to be pushed, a shift holding coil that maintains the pinion gear in a pushed state after pushing of the pinion gear is completed, and a meshing detection switch that cuts off power feeding to the shift attracting coil upon detection of a completed state of the pushing; and the push driving control unit of the pinion gear includes a voltage correction unit that makes an apply voltage to the shift attracting coil and the shift holding coil constant by issuing a push driving instruction to the shift attracting coil and the shift holding coil and applying duty control to the push driving instruction correspondingly to a power supply voltage.

11. The in-vehicle engine start control apparatus according to claim 9, wherein:

the pinion push mechanism includes a shift attracting coil that drives the pinion gear to be pushed; and the push driving control unit of the pinion gear includes a power voltage correction unit that makes an apply voltage to the shift attracting coil to be a constant attraction driving voltage by issuing a push driving instruction to the shift attracting coil and applying duty control to the push driving instruction correspondingly to a power supply voltage and lowers the apply voltage to a hold-driving voltage in one of a manner so as to lower the apply voltage after a predetermined time and a manner so as to lower the apply voltage correspondingly to an operation of a meshing sensor.

12. The in-vehicle engine start control apparatus according to claim 1, wherein:

the program memory further stores a control program constituting an automatic stop state releasing unit;

the automatic stop state releasing unit releases push driving of the pinion gear in a case where the in-vehicle engine stops according to an occurrence of the automatic stop condition of the in-vehicle engine and the pinion gear is held in a pushed state for a predetermined time or longer; and the in-vehicle engine is restarted by a manual operation using a start instruction switch.

13. The in-vehicle engine start control apparatus according to claim 1, wherein:

the rotational driving control circuit includes an output contact in a current-limit starting relay, an output contact in a full voltage starting relay of one of a normally-opened contact type and a normally-closed contact type, a current-limiting resistor connected in series to the output contact in the current-limit starting relay and connected in parallel to the output contact in the full voltage starting relay, and a current-limit starting timer;

the current-limit starting timer performs one of an operation to make the output contact in the full voltage starting relay close by allowing a coil in the full voltage starting relay of the normally-opened contact type to be biased after a predetermined delay time since a coil in the current-limit starting relay is biased according to the rotational driving instruction and an operation to make the output contact in the current-limit starting relay open by allowing a coil in the full voltage starting relay of the normally-closed contact type to be biased simultaneously with the coil in the current-limit starting relay to allow the output contact return and close by de-energizing the coil in the full voltage starting relay after a predetermined delay time; and the predetermined delay time of the current-limit starting timer is set to a time longer than a preliminary rotational driving time in the preliminary rotational driving control unit of the pinion gear.

14. The in-vehicle engine start control apparatus according to claim 1, wherein:

the automatic stop condition of the in-vehicle engine includes a condition that a power supply voltage of the in-vehicle battery is equal to or above a predetermined value;

the engine control apparatus further includes a manual starting preference control circuit;

the microprocessor issues a manual start inhibiting instruction while the microprocessor is operating normally; and the manual starting preference control circuit issues a rotational driving instruction and a push driving instruction using a start instruction switch instead of a rotational driving instruction and a push driving instruction issued by the microprocessor in a case where a charging voltage of the in-vehicle battery is low and the power supply voltage drops temporarily to an abnormal level because of a starting current of the starting electric motor unit and the microprocessor becomes unable to operate, and disables the manual starting preference control circuit by the manual start inhibiting instruction when the microprocessor resumes an operation as the power supply voltage has restored while the starting current decreases with an increase of the rotation speed of the in-vehicle engine.

* * * * *